United States Patent [19]

Buday et al.

[11] 4,161,092

[45] Jul. 17, 1979

[54] FLAT ARTICLE HANDLING SYSTEM

[75] Inventors: John M. Buday, Des Plaines; Lawrence B. Holmes, Evanston, both of Ill.; Veljko Milenkovic, Birmingham, Mich.; Bernard Stevens, Skokie, Ill.

[73] Assignee: Gard, Inc., Niles, Ill.

[21] Appl. No.: 849,108

[22] Filed: Nov. 7, 1977

Related U.S. Application Data

[63] Continuation-in-part of Ser. No. 659,029, Feb. 18, 1976, abandoned.

[51] Int. Cl.[2] ..... B65B 5/08; B65B 5/10

[52] U.S. Cl. ..... 53/244; 53/250

[58] Field of Search ..... 53/495, 54, 531, 244, 53/249, 250, 251, 542, 534; 93/93 DP; 198/422, 424, 425, 431, 436, 437, 442, 461, 530, 575, 597, 601, 405; 214/7; 271/64, 213, 214, 216, 182, 186

[56] References Cited

U.S. PATENT DOCUMENTS

| | | | |
|---|---|---|---|
| 1,545,910 | 7/1925 | Maxson | 271/202 |
| 1,828,238 | 10/1931 | Andersen | 53/534 |
| 2,177,460 | 10/1939 | Renz | 271/199 |
| 2,233,850 | 3/1941 | Rapley | 93/93 DP |
| 2,853,298 | 9/1958 | Faeber | 271/210 |
| 2,856,189 | 10/1958 | Winkler | 271/69 |
| 3,420,149 | 1/1969 | Middleditch et al. | 93/93 C |
| 3,425,184 | 2/1969 | Heliot | 53/501 |
| 3,445,107 | 5/1969 | Stoothoff | 271/177 |
| 3,502,321 | 3/1970 | McWhorter | 270/58 |
| 3,593,624 | 7/1971 | Dufour | 93/93 DP |
| 3,653,656 | 4/1972 | Stobb | 271/185 |
| 3,682,329 | 8/1972 | Dean | 214/7 |
| 3,729,189 | 4/1973 | Watson | 198/405 X |
| 3,822,793 | 7/1974 | Stobb | 214/6 H |
| 3,932,982 | 1/1976 | Klapp | 53/244 |

FOREIGN PATENT DOCUMENTS

| | | | |
|---|---|---|---|
| 6618060 | 6/1967 | Netherlands | 214/7 |

*Primary Examiner*—Horace M. Culver

*Attorney, Agent, or Firm*—Vogel, Dithmar, Stotland, Stratman & Levy

[57] ABSTRACT

A system for stacking into containers flat articles received in a shingled stream, the flat articles being disposed essentially normal to the bottoms of the containers into which they are stacked; mechanism is provided for rapidly diverting the shingled stream of flat articles from the rear of a just filled container to the front of the next empty container in a line of moving containers to feed flat articles into successive containers without interruption; containers having elongated slots in the ends are provided to facilitate the rapid shifting of the article stream from container to container in a line of containers; there also is provided a mechanism to generate a gap in the shingled stream of flat articles to facilitate transfer of the stream from a filled container to an empty container; there further is provided mechanism for diverting the shingled stream of flat articles before it reaches the containers to sample the flat articles or to reject the flat articles should they be defective; also provided are novel container conveyor systems for conveying containers to the loading station to accommodate the stacking mechanism.

47 Claims, 17 Drawing Figures

100
103
130
135
137
140
145
146
148
170
174
211
212
221
222
223
224
231
232
241
242
243
251
252
253
260
261
262
263
264
265
266
267
268
269
271
272
273
275
276
280
281
282
283
285
286
287
288
290
291
295
296
300
301
302
303
305
306
307
308
310
315
321
322
323
331
332
336
340
345
350
351
352
353
355
356
400
405
406
410
411
412
413
415
421
422
423
425
426
431

FLAT ARTICLE HANDLING SYSTEM

This application is a continuation-in-part of our copending application Ser. No. 659,029 filed Feb. 18, 1976 for LEAFLET HANDLING SYSTEM, now abandoned.

BACKGROUND OF THE INVENTION

The present invention relates generally to improvements in systems for handling shingled streams of flat articles, and particularly to systems for stacking such flat articles into containers in a continuous manner.

The system and apparatus of the present invention is capable of handling a wide range of flat articles which can be fed in shingled streams. For example, sheets of paper, leaflets including several layers of paper, small booklets, envelopes, carton blanks, and assembled carton blanks in the flattened condition, can all be handled by the apparatus of the present invention. For purposes of illustration, the system has been shown as applied to the handling of shingled streams of leaflets, but it will be understood that various other flat articles can be satisfactorily handled by the system and apparatus.

Flat articles such as leaflets and the like are commonly handled in shingled streams, i.e., streams wherein the individual leaflets are overlapped for a major portion of the length thereof. Several prior apparatus have been provided for stacking the leaflets received in a shingled stream, see for example the Maxon U.S. Pat. No. 1,545,910, the Renz U.S. Pat. No. 2,177,460 and the McWhorter U.S. Pat. No. 3,502,321, which all show stacking the leaflets in a horizontal manner. Vertical stacking of leaflets from a shingled stream is illustrated in the Rapley U.S. Pat. No. 2,223,850, the Faeber U.S. Pat. No. 2,853,298, the Winkler et al. U.S. Pat. No. 2,856,189, and the Klapp U.S. Pat. No. 3,932,982. Vertical stacking of leaflets from a non-shingled stream is shown in the Rapley U.S. Pat. No. 2,223,850, the Middleditch et al. U.S. Pat. No. 3,420,149, the Heliot U.S. Pat. No. 3,425,184, the Stoothoff U.S. Pat. No. 3,445,107 and Dutch Patent Application No. 66/18060. Stacking of shingled streams of leaflets into inclined stacks is illustrated in the Stobb U.S. Pat. Nos. 3,653,656 and 3,822,793. None of these patents however show the stacking of leaflets from a shingled stream downwardly into containers in an uninterrupted manner.

The typical system for handling the transfer of stacking from one container to another is illustrated in the Dean U.S. Pat. No. 3,862,329 where temporary storage is effected while switching from one container to another. Such a system is inherently slow in operation and further is complicated in construction and operation.

SUMMARY OF THE INVENTION

The present invention provides improved systems for handling shingled streams of flat articles in a more economical, simple and rapid manner.

This is accomplished in the present invention, and it is an object of the present invention to accomplish these desired results, by providing a system for stacking into containers flat articles with the flat articles disposed essentially normal to the bottoms of the containers, the system comprising a stacking conveyor including cooperating pinch belts for conveying the flat articles in a shingled stream, the stacking conveyor having an input end for receiving flat articles from a source thereof and a delivery end for feeding the shingled stream of flat articles from the stacking conveyor, a container conveyor disposed adjacent to the stacking conveyor for conveying containers in a continuous manner past the delivery end of the stacking conveyor, the delivery end being oriented essentially normal to the bottom of a container on the container conveyor mechanism for shifting the delivery end and the just filled container with respect to each other to place the delivery end at the front of the next empty container, stack support structure associated with the delivery end and extending into the associated container and terminating a short distance from the bottom thereof to support the forming stack of flat articles therein, and a following roller engaging the exposed side of the shingled stream and resiliently urging the shingled stream against the other pinch belt during the relative shifting of the delivery end and the container, whereby the delivery end serves to feed the shingled stream of flat articles into successive containers to stack the flat articles therein without interruption.

Another object of the invention is to provide a stacking system of the type set forth wherein the containers employed have aligned slots in the ends thereof, and mechanism is provided for shifting the delivery end of the stacking conveyor and the stack support structure rapidly from the rear of the just filled container to the front of the next empty container through the aligned slots in the containers.

In connection with the foregoing object, it is another object of the invention to provide a stacking system of the type set forth including a sensing mechanism disposed adjacent to the container conveyor for sensing a movement corresponding to the completion of the stacking of the flat articles in one conveyor to actuate the mechanism for shifting the delivery end of the stacking conveyor from the just filled container to the next empty container.

Yet another object of the invention is to provide in a stacking system of the type set forth a gap generating mechanism including a first cooperating set of pinch belts for conveying flat articles in a continuous shingled stream and along a predetermined path at a first predetermined speed, a second cooperating set of pinch belts for conveying flat articles in a continuous shingled stream along the predetermined path downstream with respect to the first set of pinch belts at a second and greater predetermined speed, a gap generating member having a first set of rollers mounted thereon and engaging the first set of pinch belts for diverting them away from the predetermined path and having a second set of rollers mounted thereon and engaging the second set of pinch belts for diverting them into the predetermined path at a point spaced along the predetermined path from the first set of rollers, and drive mechanism for shifting the gap generating member along the predetermined path at a third speed in the range from about the first speed to about the second speed to generate a gap in the shingled stream.

Still another object of the invention is to provide in a stacking system of the type set forth a diverting mechanism including a first cooperating set of pinch belts for conveying flat articles in a shingled stream, one of the pinch belts of the first set being in two sections with a space therebetween to provide a diverting station between the input end and the delivery end, a diverting conveyor having its input end adjacent to the diverting station and including a second cooperating set of pinch belts for conveying flat articles in a shingled stream, and diverting mechanism mounted adjacent to the diverting station and operative in a first condition to feed the stream of flat articles to the delivery end of the stacking conveyor and operative in a second condition to divert the stream of flat articles to the diverting conveyor and away from the delivery end of the stacking conveyor.

Yet another object of the invention is to provide a second form of diverting mechanism for use in a flat article stacking system of the type set forth, the diverting mechanism comprising a stacking conveyor having a first cooperating set of pinch belts for conveying flat articles in a shingled stream, one of the pinch belts in the first set being in two sections with a space therebetween to provide a diverting station between the input end of the stacking conveyor and the delivery end thereof, a diverting conveyor pivotally mounted adjacent to the diverting station and including a second cooperating set of pinch belts for conveying flat articles in a shingled stream, means for pivoting the diverting conveyor between a first position wherein its input end is spaced away from the diverting station and a second position wherein its input end is disposed at the diverting station, and diverting mechanism mounted adjacent to the diverting station and operative in a first condition and when the diverting conveyor is pivoted to its first position to feed the stream of flat articles to the delivery end of the stacking conveyor and operative in a second condition when the diverting conveyor is pivoted to its second position to divert the stream of flat articles to the diverting conveyor and away from the delivery end of the stacking conveyor.

In connection with the several foregoing objects, another object of the invention is to provide a stacking system for flat articles that incorporates both mechanism for generating a gap in a shingled stream of flat articles and mechanism for diverting flat articles from a shingled stream of flat articles, whereby the diverted stream can be diverted back to the delivery end of the stacking conveyor by providing a gap in the shingled stream which permits reestablishment of flow to the delivery end of the stacking conveyor.

Yet another object of the invention is to provide in a flat article stacking system of the type set forth a container conveyor which is operative to reverse the direction of flow of the containers after filling thereof with flat articles so as to accommodate flow of the shingled stream of flat articles in a first direction and flow of empty containers in a direction opposite to the first direction with the filled containers then being moved in the first direction.

Still another object of the invention is to provide a flat article stacking system of the type set forth a stacking conveyor wherein the delivery end is turned 180° about the axis of the shingled stream so as to accommodate flow in the same direction of the shingled stream of flat articles and the line of empty containers and the line of filled containers.

Yet another object of the invention is to provide an improved container shaped and designed for cooperation with the flat article stacking system of the present invention.

Further features of the invention pertain to the particular arrangement of the parts of the flat article handling system, whereby the above outlined and additional operating features thereof are attained.

The invention, both as to its organization and method of operation, together with further features and advantages thereof will best be understood with reference to the following specification taken in connection with the accompanying drawings.

DESCRIPTION OF THE PREFERRED EMBODIMENTS

Figure 1:
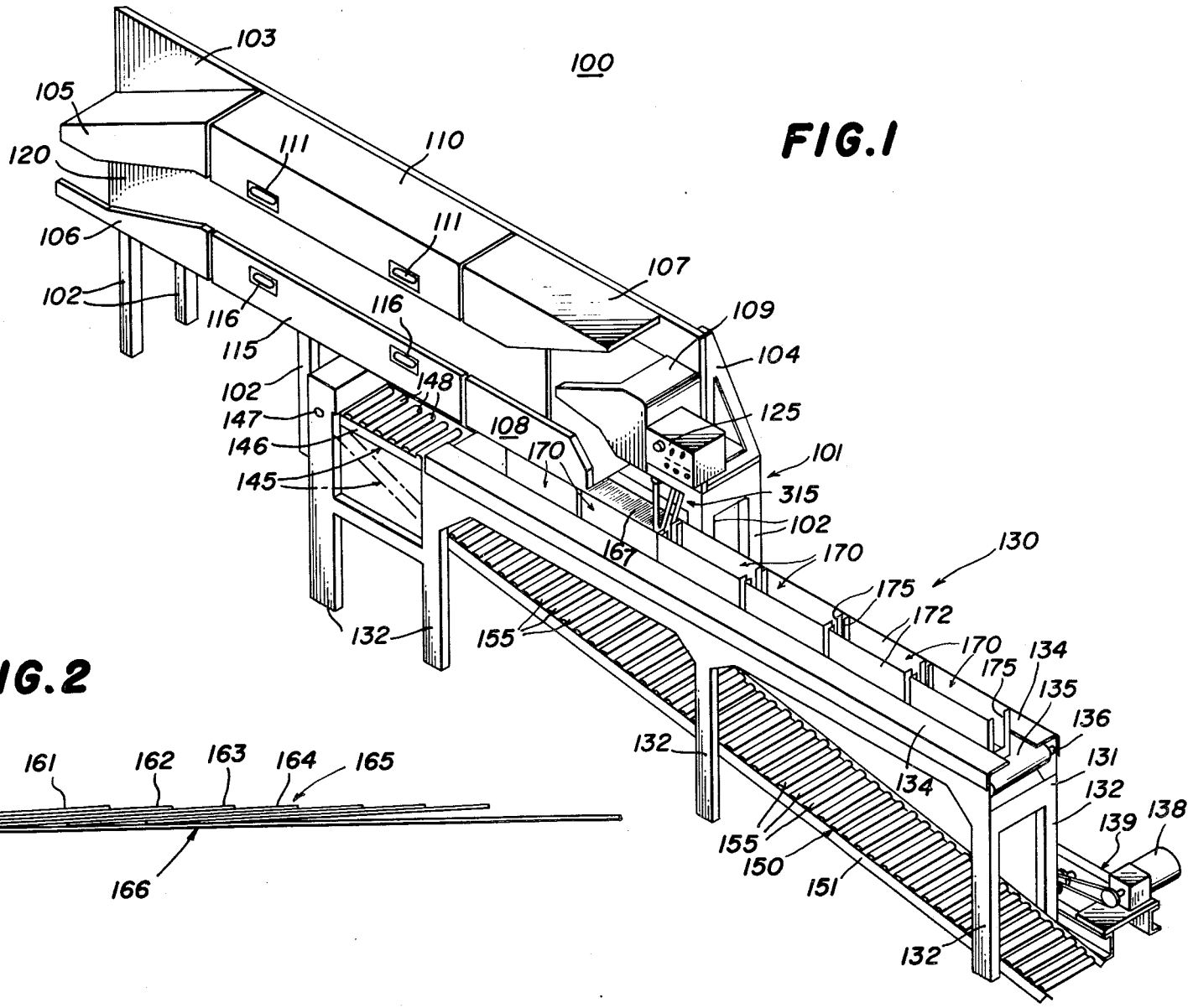
FIG. 1 is a perspective view of a flat article or leaflet handling machine made in accordance with and embodying the principles of the present invention and utilizing the improved containers and the leaflet handling methods of the present invention.

There is illustrated in FIG. 1 of the drawings a machine 100 for handling shingled streams of flat articles of leaflets, the machine 100 more particularly embodying the apparatus and method for transporting shingled streams of leaflets, stacking shingled streams of leaflets, generating gaps in shingled streams of leaflets and rejecting or withdrawing samples of leaflets from shingled streams thereof, all in accordance with and embodying the principles of the present invention. The machine 100 includes a main frame 101 supported at an appropriate vertical position by a plurality of legs 102.

A rear plate 103 is provided on which are mounted many of the conveyor parts to be described hereinafter, the rear plate 103 being braced as at 104 upon the main frame 101. As illustrated, a plurality of covers are provided over the moving parts of the system including upper and lower infeed covers 105 and 106, upper, intermediate and lower outfeed covers 107, 108 and 109, respectively, an upper access panel 110 having a pair of handles 111, a lower access panel 115 having a pair of handles 116 and a front plate 120. Mounted on the frame adjacent to the intermediate outfeed cover 109 is a control panel 125 on which are mounted the several manual operating controls for the machine 100.

An empty container conveyor system generally designated by the numeral 130 is provided to feed empty containers from the right in FIG. 1 toward the left and specifically to a stacking station at the stacking conveyor delivery end 315 just below the control panel 125. The conveyor system 130 includes a frame 131 supported by a plurality of legs 132 and having a pair of opposed guides 134 having the facing edges spaced apart a distance slightly greater than the width of a container to be conveyed by the system 130. Mounted upon the frame 131 is a continuous conveyor belt 135 which is supported and engaged at the right hand end by a drive roller 136 and is supported at the other end by a support roller 137 (see FIGS. 3A and 3B also). A drive motor 138 is provided for the conveyor belt 135 and has a transmission system 139 that operatively connects the output of the motor 138 to the drive roller 136 so as to operate the conveyor belt 135 in a continuous manner at a uniform predetermined speed. To insure positive engagement between the conveyor belt 130 and the containers disposed thereon, a plurality of pusher bars 140 (see FIGS. 3A and 3B) are provided and spaced appropriately so as positively to feed the containers one at a time in a continuous line.

Figure 3A:
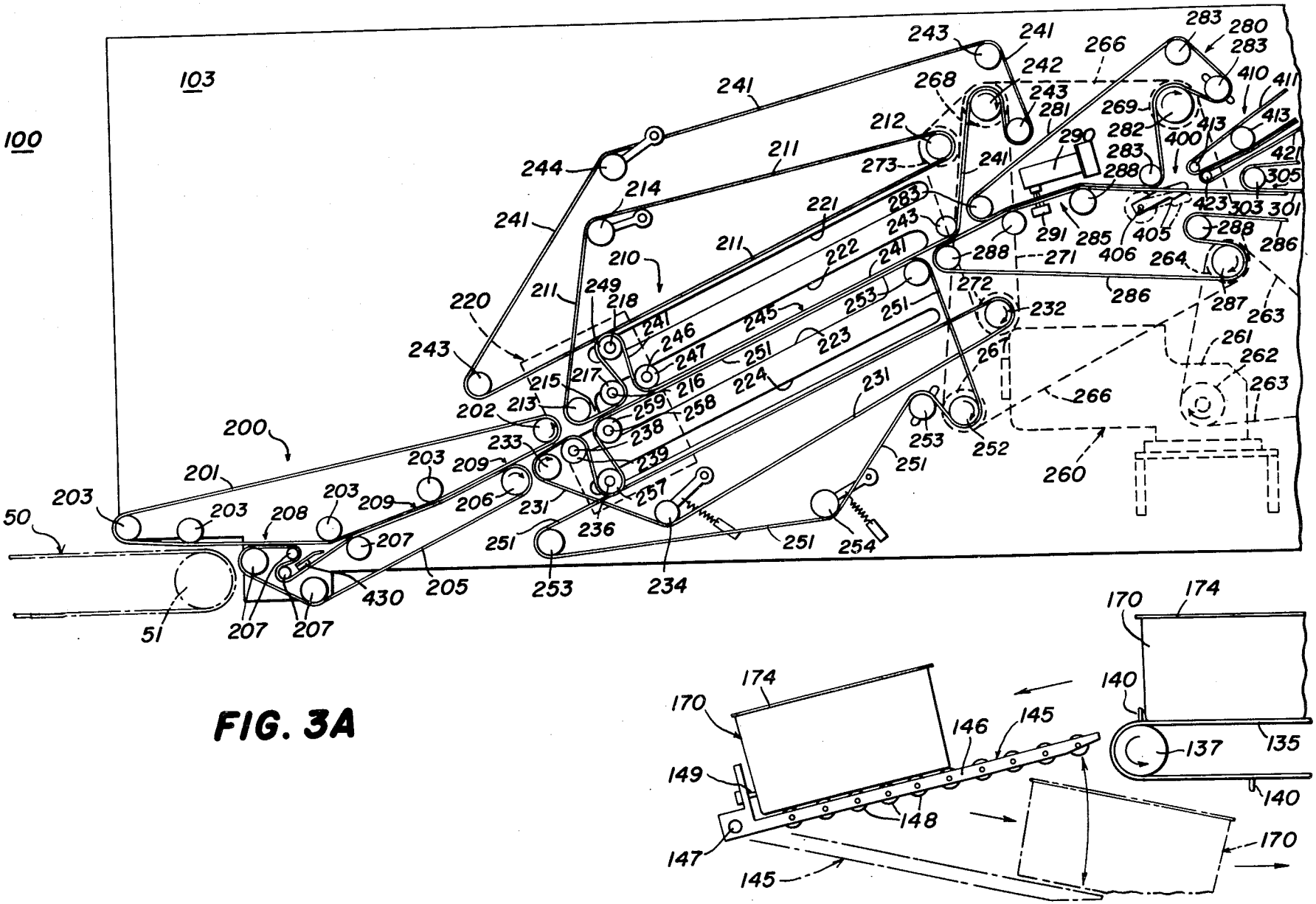
FIGS. 3A and 3B taken together diagrammatically illustrate the construction and operation of the various conveyor and control systems forming a part of the leaflet handling machine of FIG. 1.
Figure 3B:
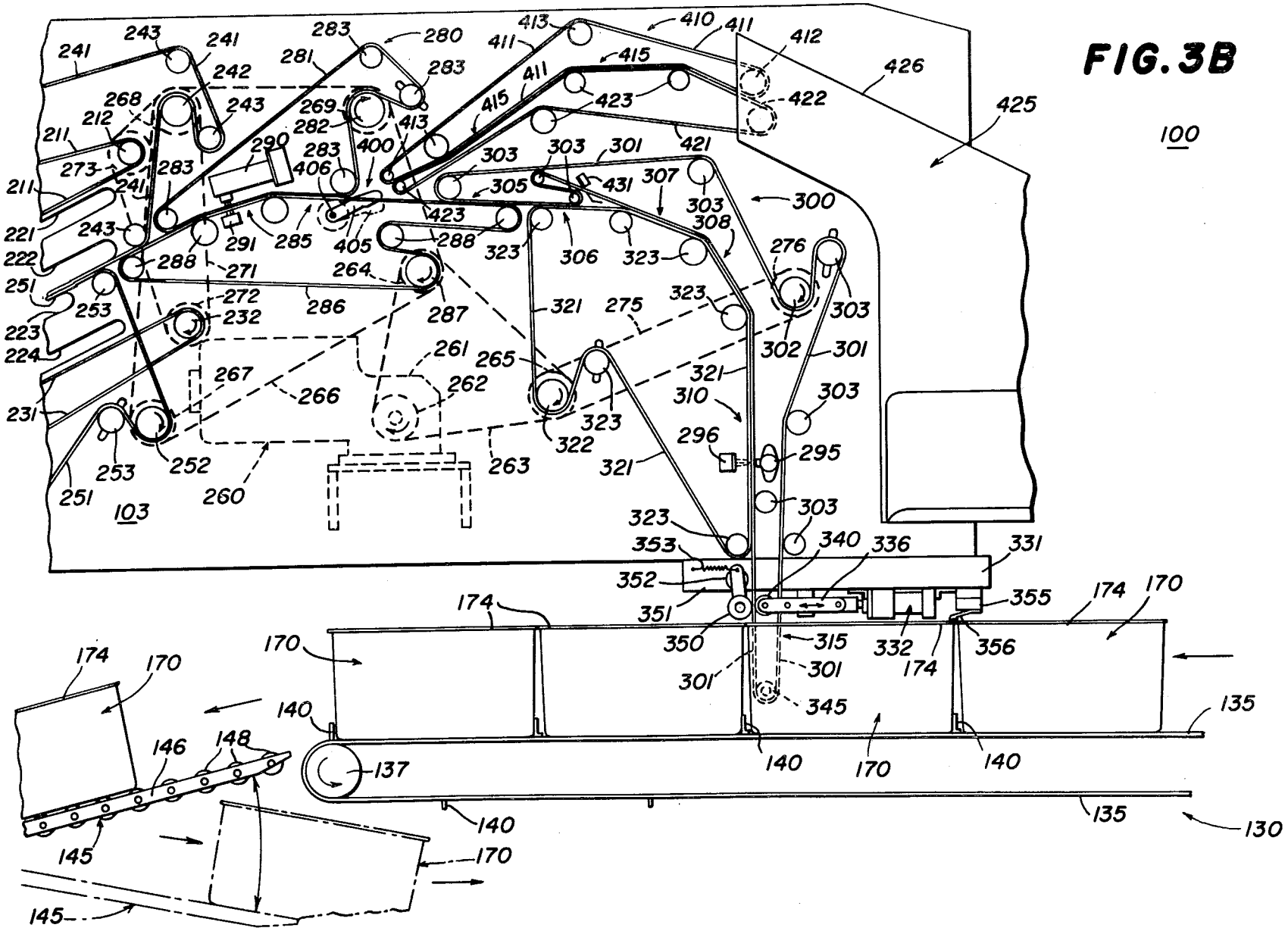

The filled containers exit from the left hand end of the conveyor system 130 and move onto a tilting roller conveyor section 145 (see FIGS. 1, 3A and 3B). The roller conveyor section 145 includes a frame 146 that is pivoted as at 147 so that it can move between the solid and dashed line positions illustrated in the drawings, the frame 146 being suitable weighted so that it is in the upper solid line position to receive filled containers, and the weight of the filled container pivots the tilting roller conveyor section 145 to the dashed line position. A plurality of rollers 148 is mounted on the frame 146 to facilitate movement of the filled containers therealong and a stop 149 is provided (see FIG. 3A) to limit the distance of travel of the filled container to the left in FIG. 3A.

Tilting of the roller conveyor section 145 downwardly to the dashed line position thereof feeds the filled container thereon to an outfeed conveyor 150 disposed beneath the conveyor system 130. The conveyor 150 includes a frame 151 that supports a plurality of rollers 155 that serve to convey the filled containers under the urging of gravity downwardly in FIG. 1 and FIGS. 3A and 3B from left to right in the direction of the arrows in FIGS. 3A and 3B.

Figure 2:
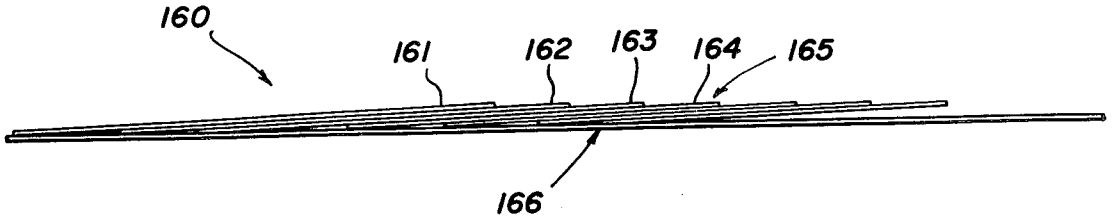
FIG. 2 is a diagrammatic illustration of a typical shingled stream of leaflets as utilized in the present invention.

Referring to FIG. 2, there is diagrammatically illustrated a shingled stream 160 comprised of individual leaflets 161, 162, etc., it being understood that other flat articles may comprise the shingled stream 160. The several leaflets are essentially identical one to the other and are of uniform length and width and typically are printed. Each leaflet may consist of a simple piece of paper, or may contain two or more folds. The leaflets are shown in a continuous shingled stream 160, i.e., consecutive leaflets in the stream overlap one another over the major portion of their length, the length being defined as the dimension of the direction of motion of the stream 160. With respect to two consecutive leaflets, the preceding one or the leading one is located below, and the one that follows or the trailing one is on top, covering all but the most forward portion of the preceding leaflet. For convenience in reference, the upper side in FIG. 2 is referred to as the trailing side of the stream 160, while the lower side in FIG. 2 is referred to as the leading side of the stream 160. The machine of FIG. 1 serves to provide a stack 167 of the leaflets in a container (see FIG. 1).

Figure 11:
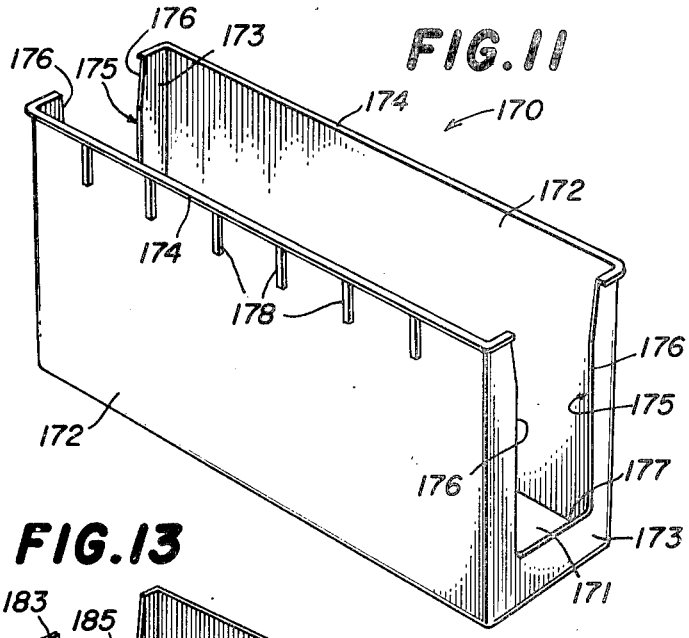
FIG. 11 is a perspective view of a first form of a container constructed and designed to be used with the stacking mechanism of the present invention.
Figure 12:
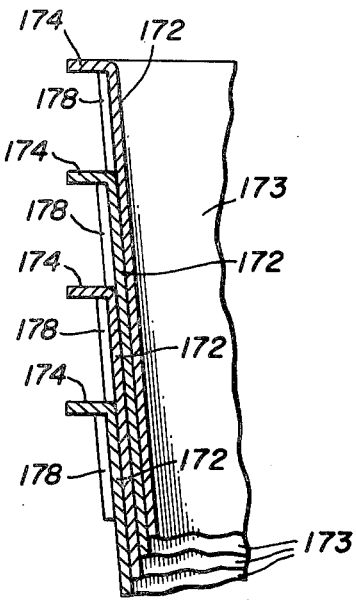
FIG. 12 is a fragmentary and diagrammatic view illustrating the manner of stacking the containers of FIG. 11.

In order to realize to the fullest extent the advantages of the machine of FIG. 1, it is desirable to utilize in connection therewith containers of special construction, one preferred form of such a container being the container 170 best illustrated in FIGS. 11 and 12 of the drawings. The container 170 is preferably integral and molded of a synthetic organic plastic resin, a suitable plastic resin being polyethylene resin. As illustrated, the container 170 includes a generally rectangular bottom wall 171 that integrally carries a pair of opposed side walls 172 and a pair of opposed end walls 173, all integrally joined at the junctures therebetween. The side walls 172 slightly taper upwardly and outwardly away from each other toward the upper edges thereof, and the end walls 173 likewise slightly taper upwardly and outwardly away from each other toward the upper edges thereof (see FIG. 3B also). The upper edges of the several walls carry a rim 174 that extends outwardly and is disposed essentially parallel to the bottom wall 171. The end walls 173 are each provided with a generally rectangular slot 175 therein, the side edges 176 of the slot 175 being parallel in the lower portions thereof and diverging outwardly at the upper portions thereof and being spaced from the adjacent juncture with the adjacent side wall 172. The bottom edge 177 of the slot 175 is disposed substantially parallel to the bottom wall 171 and is spaced upwardly therefrom a short distance, whereby the portions of the illustrated end wall 173 that remain are adequate to hold the adjacent end of a stack 167 of leaflets. There further is provided on the outer surfaces of the side walls 172 just below the rim 174 outwardly extending ridges 178, six such ridges 178 having been shown for purposes of illustration. The tapered configuration of the walls 172 and 173 permit stacking of the containers 170 when not in use so as to conserve space. To prevent binding or wedging of the containers 170 inside one another, the containers 170 are built and arranged so that the ridges 178 on the upper container abut the rim 174 on the immediately lower adjacent container, this construction insuring easy withdrawal of the containers 170 one from another without binding between the tapered surfaces of the various walls 172 and 173.

The provision of the slots 175 and the material of construction of the container 170 render the container 170 somewhat flexible in the lateral direction, i.e., in a direction essentially normal to the side walls 172. As a result, when filled containers 170 are placed side by side on a pallet or the like, for further transportation and storage, and are pressed together in a lateral direction, the flexibility described will allow each of the container side walls 172 to move toward each other until they are essentially parallel (no longer tapered), and conforming to the sides of the stack 167 of leaflets contained therein. If the containers 170 are placed on a pallet with the bottoms downward, this described side wall deflection serves securely to hold the stacks 167 of leaflets in their properly aligned edge condition. When another layer of the containers 170 is placed on top of the first layer of containers 170 on a pallet, the described deflection also insures that the bottom walls 171 of the upper containers 170 rest on the rims 174 of the lower containers 170, and not on the stack of leaflets 167 contained therein.

Another possible method of stacking full containers 170 on a pallet is to lay the containers 170 on one of their side walls 172. Each container 170 on top is placed in the direction opposite of the container 170 below it (the rim 170 of the upper container 170 resting on what is normally the bottom of the container 170 below, and vice versa). In this arrangement, the weight of the full container 170 above is sufficient to deform the side walls 172 of the container 170 below to parallelism. Furthermore, the protruding ridges 178 on the side walls 172 of the containers 170 are so shaped that they interlock, keeping the containers 170 aligned, and preventing the containers 170 above from sliding relative to the containers 170 below.

Figure 13:
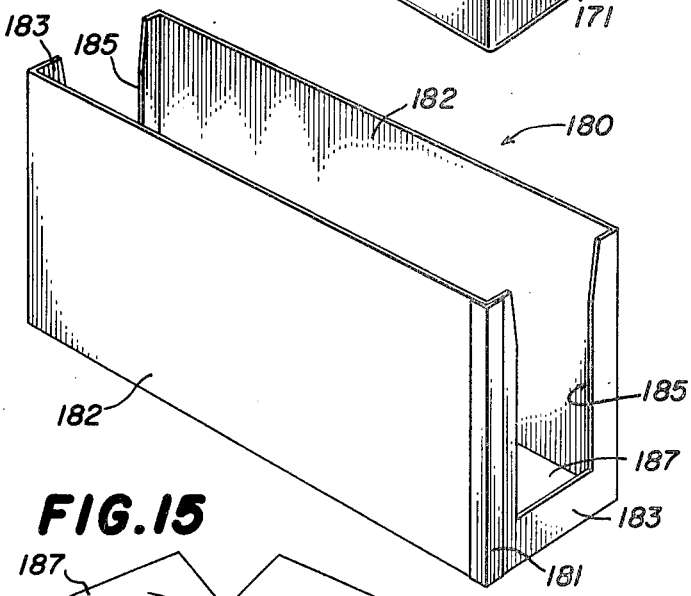
FIG. 13 is a perspective view of a second embodiment of container constructed and designed to be used with the stacking mechanism of the present invention.
Figure 14:
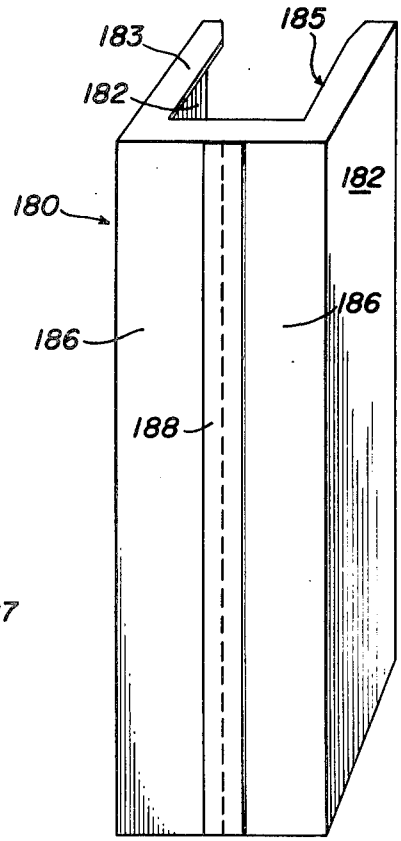
FIG. 14 is a perspective view illustrating the outer bottom portion of the container of FIG. 13.
Figure 15:
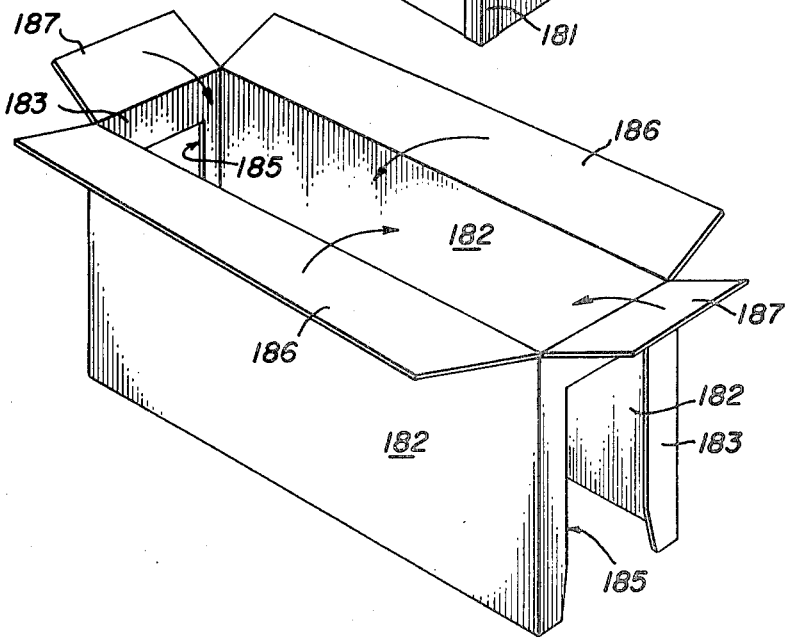
FIG. 15 is a perspective view further illustrating the construction of the container of FIGS. 13 and 14.

There is illustrated in FIGS. 13 to 15 of the drawings a disposable container 180 that is made from chipboard or other suitable inexpensive material. The container 180 is formed of a single flat sheet of board, and prior to erection can be stored in the flat condition. Prior to use in the machine 100, the containers 180 are formed using standard box forming procedures to provide the erected container 180 illustrated in FIGS. 13 and 14 of the drawings. More particularly, the container 180 includes for integrally interconnected panels that are first formed into tubular shape and secured in such shape by use of a tape 181, the four panels providing two opposed side walls 182 and two opposed end walls 183. As is illustrated in FIG. 15, one of the edges of each of the four panels forming the walls 182 and 183 is provided with a flap, the side walls 182 being provided with bottom side flaps 186 and the end walls 183 being provided with bottom end flaps 187. In forming the container 180, the flaps 186 and 187 are folded inwardly as indicated by the arrows in FIG. 15, the end flaps 187 being folded in first and the side flaps 186 being folded in last and secured in place by a strip of tape 188 (see FIG. 14). The end walls 183 are each provided with a slot 185 shaped like the slot 175 described above.

Figure 4:
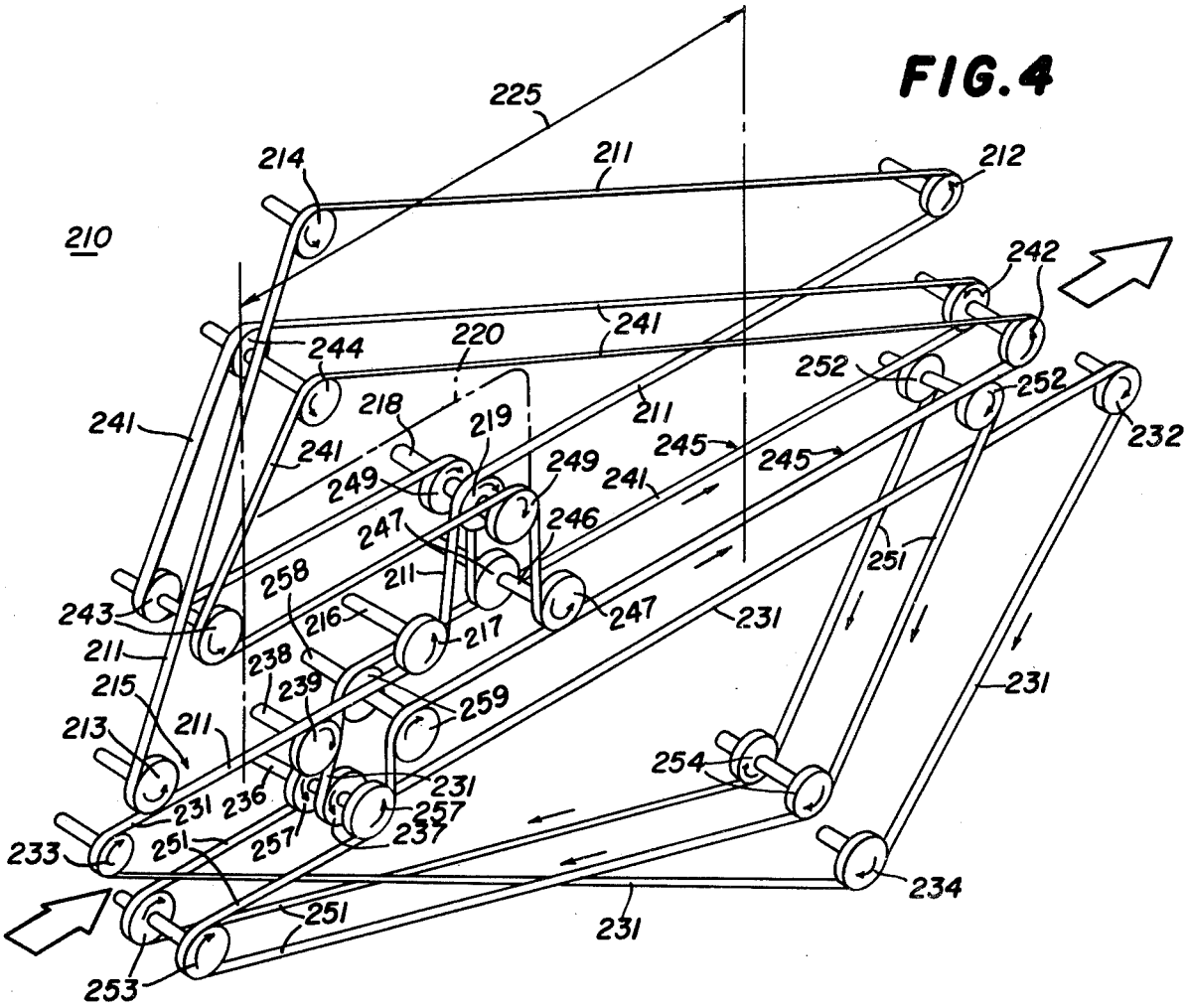
FIG. 4 is a simplified and schematic perspective view of the conveyor systems incorporated in the gap generating mechanism forming a part of the machine of FIG. 1.

Referring to FIGS. 3A, 3B and 4 the several conveyor systems incorporated in the leaflet handling machine 100 of FIG. 1 will be described in detail. The shingled streams of leaflets are obtained from a printing press or other source thereof on a supply conveyor 50 (see FIG. 3A) supported by rollers 51. In practice, several parallel shingled streams may be transported side by side away from the printing press or other source. Each shingled stream within the machine 100 is fundamentally fed by cooperating pairs of pinch belts which run at the required speed and support the shingled stream on the opposite side thereof, i.e., both the trailing side 165 and the leading side 166 are contacted by a cooperating pinch belt or pinch belts to guide the shingled stream 160 as required. For simplicity of description, a single shingled stream will be used to illustrate the invention and although two spaced apart pairs of pinch belts ordinarily engage each shingled stream 160, for simplicity in illustration and description only a single pair of pinch belts will be described in detail, except where two cooperating sets of pinch belts are required.

The shingled stream 160 from the supply conveyor 60 is fed through the input end of an infeed conveyor 200 (see FIG. 3A). The infeed conveyor 200 is essentially mounted upon the rear plate 103 and includes an upper pinch belt 201 and a lower pinch belt 205. A drive roller 202 supports and drives the upper pinch belt 201 and a drive roller 206 supports and drives the lower pinch belt 205; guide rollers 203 and 207, respectively, are provided where required. It will be understood that the drive rollers 202 and 206 will be driven by mechanism (not shown), an illustrative speed of travel of the pinch belts 201 and 205 being 18 inches per second. Certain reaches of the upper and lower pinch belts 201 and 205 are spaced close together so as to provide a first conveying section 208 immediately adjacent to the supply conveyor 50 and an upwardly inclined second conveying section 209. The conveying sections 208 and 209 serve smoothly to feed a shingled stream 160 of leaflets from the supply conveyor 50 to the input end of a gap generating mechanism 210 to be described more fully hereinafter.

The shingled stream 160 is then fed through a gap generating mechanism 210 and from the gap generating mechanism 210 to a transfer conveyor 280 and from the transfer conveyor 280 to a stacking conveyor 300. The details of the construction and operation of the gap generating mechanism 210 and the transfer conveyor 280 will be described more fully hereinafter.

Referring to FIGS. 3B and 5 to 7, the apparatus for stacking the leaflets in the shingled stream 160 into the containers 170 in a continuous and uninterrupted manner will now be described. The stacking conveyor 300 includes an upper pinch belt 301 (two belts 301 being provided but only one being described in the interest of brevity) which is supported by a drive roller 302 (see FIG. 3B) and a plurality of support rollers 303, and shiftable delivery rollers 340 and 345. A lower pinch belt 321 is provided (two belts 321 actually being provided but only one being described in the interest of brevity) to cooperate with the upper pinch belt 301, the lower pinch belt 321 being supported by a drive roller 322 and a plurality of support rollers 323. The drive rollers 302 and 322 are driven by drive mechanism to be more fully described hereinafter and typically operate to drive the pinch belts 301 and 321 at a speed of 36 inches per second. Certain reaches of the pinch belts 301 and 321 are disposed adjacent to each other to provide leaflet conveying sections, a first such section 305 receiving the shingled stream 160 from the transfer conveyor 280 and conveying the shingled stream 160 via conveying sections 306, 307 and 308 to a vertically arranged conveying section 310. It will be noted that the pinch belt 301 has a pair of opposed reaches that extend downwardly below the lowermost one of the guide rollers 323 to provide a delivery end 315 for the stacking conveyor 300, the delivery end 315 extending downwardly into a container 170 disposed upon the container conveyor 130.

Figures 5, 6, 7:
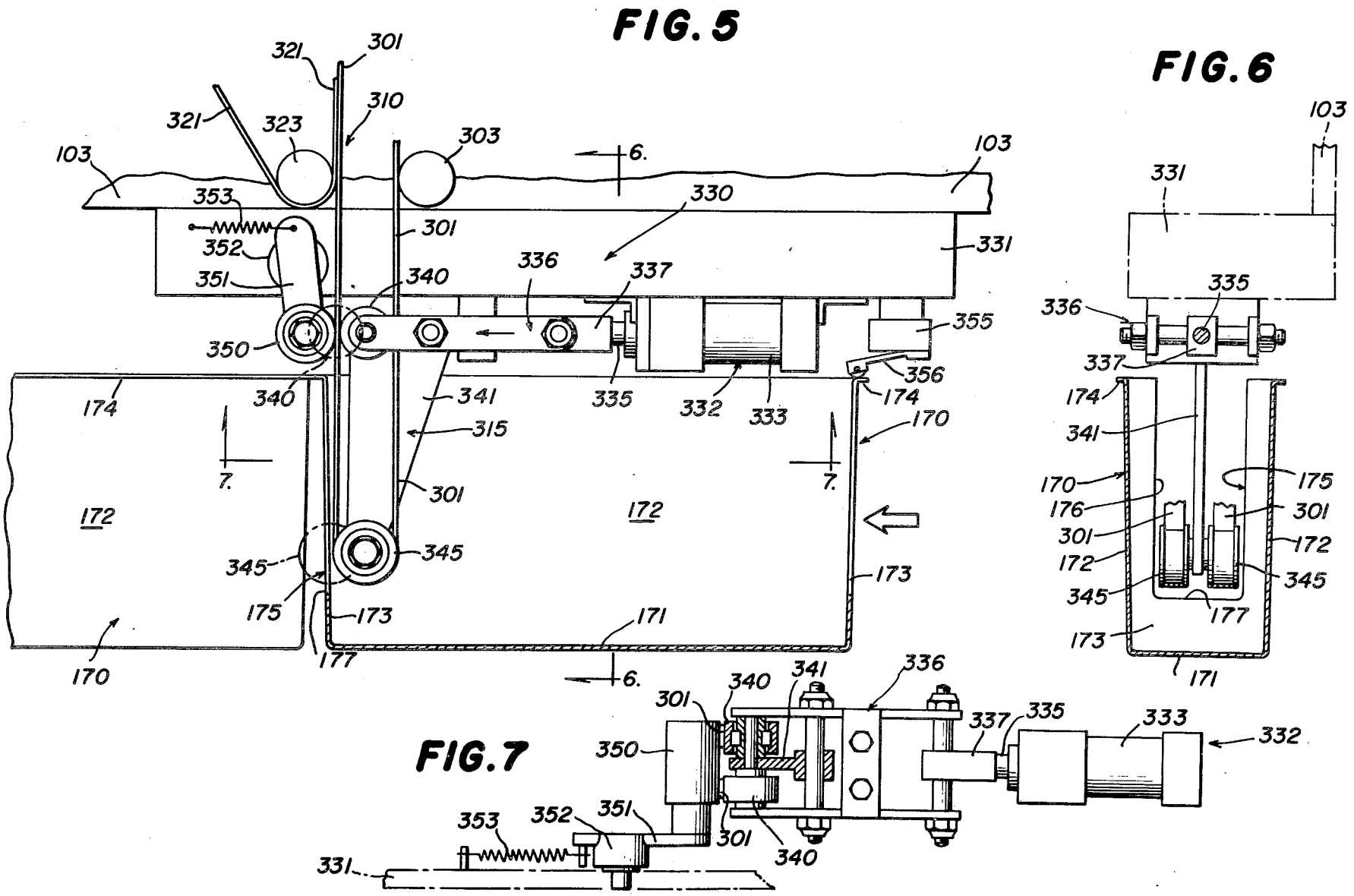
FIG. 5 is an enlarged fragmentary view of the delivery end of the stacking conveyor and showing the relationship thereof with respect to the containers during the stacking operation.
FIG. 6 is a partial view in vertical section along the line 6—6 of FIG. 5.
FIG. 7 is a partial horizontal view with certain portions broken away along the line 7—7 of FIG. 5.

Turning now to FIGS. 5 to 7 of the drawings, further details of the construction and operation of the delivery end 315 will be given as well as the description of the construction and operation of a shifting mechanism 330 for rapidly shifting the delivery end 315 from a just filled container 170 to the next empty container 170. The shifting mechanism 330 is mounted upon a base 331 and includes a double acting air motor 332 provided with a cylinder 333, a piston 334 (see FIG. 8) and a piston rod 335 connected to the piston 334 and extending from the cylinder 333. The outer end of the piston rod 335 is connected by a coupling 337 to a frame 336 that carries the delivery rollers 340 and 345. More specifically, an arm 341 is provided on the frame 336 and extends downwardly therefrom as is best seen in FIG. 6 and carries on the lower end thereof the pair of delivery rollers 345. The delivery rollers 340 are mounted directly upon the frame 336 (see FIG. 7) and cooperate with the delivery rollers 345 to guide the pinch belt 301 in the delivery end 315 thereof.

Cooperating with the delivery rollers 340 to guide a shingled stream of leaflets into the associated container 170 is a shiftable roller 350 that has a longitudinal extent such as to cooperate with both of the delivery rollers 340 (see FIG. 7). The roller 350 is mounted upon an arm 351 that is pivoted as at 352, the arm 351 carrying a spring 353 that continually urges the roller 350 against the adjacent surface of the shingled stream 160 passing thereby.

Referring to FIG. 6, it will be seen that the delivery rollers 345 extend well into the associated container 170 yet can pass through the slots 175 in the ends 173 thereof, and that the delivery rollers 340 are disposed above the rims 174 of the associated containers 170.

Figure 8:
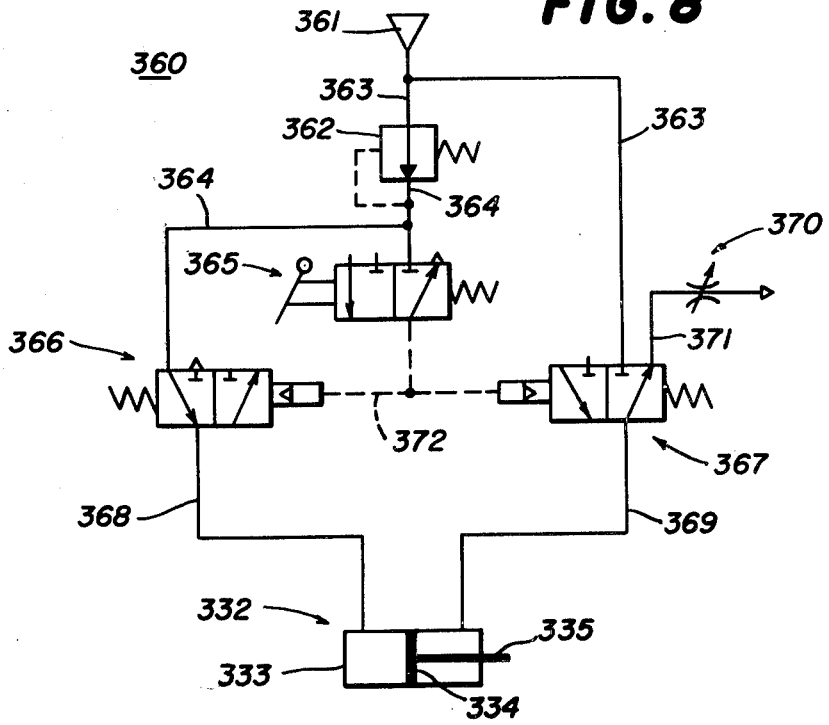
FIG. 8 is a schematic diagram of the pneumatic circuit used to control the shifting of the delivery end of the stacking conveyor illustrated in FIGS. 5 to 7 of the drawings.

The positions of the delivery rollers 340 and 345 can be rapidly shifted so as to divert a shingled stream 160 from a just filled container 170 to the next empty container 170, such shifting being under the control of a pneumatic control system 360 which is best illustrated in FIG. 8 of the drawings. The system 360 includes an air supply 361 that feeds air through a hose 363 to a pressure reducer 362. The outlet of the pressure reducer 362 is connected to a hose 364 that connects both to a 3-way pilot valve 365 and a first 3-way control valve 366. The control valve 366 is connected by a hose 368 to the air cylinder 333 of the air motor 332 on one side of the piston 334. The air cylinder 333 on the other side of the piston 334 is connected by a hose 369 to a second 3-way control valve 367. A second input to the control valve 367 is from the air supply 361 via the hose 363. The outlet from the control valve 367 is connected by a hose 371 to an exhaust control 370. The 3-way pilot valve 365 and the two 3-way control valves 366 and 367 are further interconnected mechanically as at 372.

The stacking conveyor 300 so described is operative to take a shingled stream 160 of pamphlets travelling essentially horizontally along the conveying section 305 with the trailing side 165 on top and the leading side 166 on the bottom and in a direction away from the supply conveyor 50, and then change the direction of travel so that in the conveying section 310 the shingled stream 160 is travelling essentially vertically with the leading side 166 disposed toward the supply conveyor 50 and the trailing side 165 disposed away from the supply conveyor 50. The bottom pinch belt 321 terminates above the delivery rollers 340, thus to provide delivery end 315 of the upper pinch belt 301 supported essentially by the delivery rollers 340 and 345. In other words, the delivery end 315 of the upper pinch belt 301 extends downwardly past the lowermost reach of the lower pinch belt 321 and into the adjacent container 170 and terminates just above the lower edge 177 of the associated slot 175. The lower pinch belt 321 further terminates at a point spaced from the bottom of a container 170 disposed therebelow a distance slightly greater than the length of a leaflet in a shingled stream 160. As a result, as soon as the leading edge of a leaflet almost reaches the bottom of the container 170, the leaflet is no longer pinched between two belts. One surface of the leaflet is supported by the portion of the stack 167 already formed in the container 170 with the leading edge resting on the bottom of the container 170, and the other surface of the leaflet is supported by the portion of the upper pinch belts 301 supported by the delivery rollers 340 and 345, that portion of the pinch belts 301 guiding the leaflet to complete its travel, and also serving to prevent the leaflet from toppling over and sliding along the container bottom wall 171.

As the stack 167 is being formed in the container 170, the container 170 being filled and all the empty containers that follow are slowly conveyed in the direction indicated by the arrow in FIG. 3B., i.e., from right to left and toward the supply conveyor 50. The speed of this motion of the containers 170 is adjusted to match the speed at which leaflets accumulate in the container 170, i.e., the speed at which the stack 167 is being formed. Thus, the "bottom" of the stack, which rests against the leading vertical end of the container 170 is moving, whereas the point at which the stack 167 is being formed remains fixed in space. In this way leaflets are being fed continuously and in an uninterrupted manner into the container 170 disposed below the delivery end 315 so as completely to fill the container 170 with leaflets from the shingled stream 160. It will be appreciated that the slots 175 in the ends of the container 170 are necessary to permit the delivery end 315 to pass therethrough when completing the filling of a container 170.

When one of the containers 170 has been filled, it is necessary to start a new stack 167 in the next empty container 170 in line. The minimum distance between the end of one stack 167 and the beginning of the next stack 167 is equal to the distance between the containers 170 plus the thickness of the two container end walls 173 plus the longitudinal extent of the two rims 174. This distance represents a gap in the formation of the stacks 167. Since it is desired to feed the leaflets in an uninterrupted manner into the containers 170, it is necessary to provide a small but rapid displacement between the delivery end 315 and the containers 170. Such relative displacement could be accomplished by moving either the delivery end 315 or the containers 170. Means to shift the delivery end 315 is described herein.

Referring to FIGS. 3B and 5 to 7 of the drawings, it will be seen that there has been provided an air pilot valve or switch 355 with a lever arm 356 for contacting the rim 174 of the trailing container 170, i.e., the container 170 just behind the container 170 that has just been filled on the conveyor 130. In FIG. 5, the dashed line positions of the delivery rollers 340 and 345 illustrate the positions thereof at the completion of the loading of leaflets into the container 170 disposed to the left therein. In accordance with the present invention it is necessary rapidly to shift the rollers 340 and 345 from the dashed line positions thereof to the full line positions thereof in FIG. 5 in switching the shingled stream from the container 170 on the left to the container 170 on the right, i.e., from the just filled container 170 to the next empty container 170. The time for making the shift is sensed by the arm 356 contacting the rear wall 173 of the container 170 so as to actuate the switch 355. The switch 355 is connected (by circuitry not shown) to the 3-way pilot valve 365 to cause actuation thereof. Actuation of the valve 365 in turn actuates the valves 366 and 367 so as to cause a rapid movement of the piston rod 335 of the air motor 332 to the right in FIG. 5 followed by a slow return of the piston rod 335 to the left. The sudden movement of the piston rod 335 causes a corresponding sudden movement of the delivery rollers 340 and 345 from the dashed line positions thereof in FIG. 5 to the solid line positions thereof, followed by a slow return of the delivery rollers 340 and 345 to the dashed line positions thereof.

This movement of the delivery rollers 340 and 345 causes a corresponding movement of the portions of the shingled stream 160 guided thereby. To insure that the shingled stream 160 follows this movement, the spring-loaded roller 350 described above has been provided. If the shingled stream 160 is continuous and has no interruption therein, this described action of the delivery rollers 340 and 345 and the belt reaches 301 carried thereby will serve to deform the shingled stream 160 to the right over the end of the container 170 on the left, i.e., the container just filled. The leaflets in the shingled stream 160 whose leading edges are already below the top rim 174 of the container 170 being filled must complete their motion into the nearly filled container 170. The deformation of the shingled stream 160, however, causes the next leaflet in line to fan out, its leading edge separting from the shingled stream 160 by an amount which is sufficient to make the leaflet enter the next empty container 170. Once this one leaflet enters into the next empty container 170, it will guide all subsequent leaflets in the shingled stream 160 along a like path. Such guidance is a consequence of the shingled configuration of the stream 160. As the new stack 167 is being formed in the new container 170, the delivery rollers 340 and 345 and the associated portion of the pinch belt 301 are slowly returned by the action of the pneumatic control system 360 to the original positions so as to be ready to perform the next shifting operation when required.

The success of the above described procedure of shifting the shingled stream 160 from the just filled container to the next empty container will depend on the properties of the flat articles or leaflets being handled, i.e., their size, thickness, consistency of the paper, number of folds, if any, etc. It has been found that some types of flat articles or leaflets cannot be shifted successfully in shingled streams by the foregoing apparatus and method. For such flat articles of leaflets it is therefore necessary to generate a gap in the shingled stream 160 in order to initiate a new stack. Leaflets preceding the gap will be fed into the container 170 just being filled, and leaflets arriving after the gap will be shifted to the next empty container 170. Such systems will require the shiftable movement between the delivery end 315 and the containers 170, such as described above, the shifting occurring while the gap is at the delivery end 315, i.e., shifting of the shingled stream 160 is initiated at the instant that the gap in the shingled stream has reached the vicinity of the top rim 174 of the containers 170.

One preferred form of gap generating mechanism 210 is illustrated in FIGS. 3A and 4 of the drawings. As illustrated, the gap generating mechanism 210 includes an upper entrance pinch belt 211 and a lower entrance pinch belt 231 cooperating to receive a shingled stream of leaflets 160 from the infeed conveyor 200, and specifically from the second conveying section 209 thereof. The upper pinch belt 211 is supported and driven by a drive roller 212 and is supported by a plurality of stationary support rollers 213, and also is provided with a tension roller 214 to maintain the desired operating tension therein. There further is provided a frame 220 for the gap generating mechanism that carries thereon a plurality of shafts for movement therewith, the frame 220 being shiftable from the position illustrated in FIG. 3A upwardly and to the right, the distance of shifting possible for the frame 220 typically being 18 inches and being diagrammatically illustrated in FIG. 4 by the line 225, i.e., the rear end of the frame 220 being shiftable from the vertical line at the left hand end of the line 225 to the vertical line at the right hand end of 225, the frame 220 being suitably mounted upon the rear plate 103 to accommodate such shifting movement. The shiftable shafts that are mounted upon the frame 220 extend through suitable guide tracks in the rear plate 103, and specifically through guide tracks 221, 222, 223, and 224, respectively.

More specifically, a first movable shaft 216 is provided mounted upon the frame 220 and shiftable therewith extending through the guide track 222 and carrying a movable guide roller 217 engaging the upper pinch belt 211. A second movable shaft 218 also mounted upon the frame 220 extends through the guide track 221 and carries a movable guide roller 219 thereon engaging the upper pinch belt 211 (see FIG. 4). The lower entrance pinch belt 231 is supported and driven by a drive roller 232 and is also supported throughout a major portion of the length thereof by stationary support rollers 233. A tension roller 234 is further provided to maintain the pinch belt 231 in the desired operating tension. Other portions of the pinch belt 231 are supported by a guide roller 237 on a movable shaft 236 mounted upon and carried by the frame 220 and extending through the guide track 224. A second movable guide roller 239 is provided for the pinch belt 231, the roller 239 being supported upon a movable shaft 238 carried by the frame 220 and extending through the guide track 223.

The gap generating mechanism 210 further includes two spaced-apart fast upper pinch belts 241 and two spaced-apart fast lower pinch belts 251. The pinch belts 241 are supported and driven by drive rollers 242, a plurality of stationary support rollers 243 and are further provided with suitable tension rollers 244 to maintain the desired operating tensions therein. Also guiding the pinch belts 241 are movable guide rollers 247 mounted upon a movable shaft 246 disposed in the guide track 222, and movable guide rollers 249 that are mounted upon the movable shaft 218 described above. The pinch belts 251 are supported and driven by drive rollers 252, are supported by stationary support rollers 253 and further engage tension rollers 254 that maintain the desired operating tensions therein. Also engaging the pinch belts 251 are guide rollers 257 that are mounted on the movable shaft 236 described above, and guide rollers 259 that are mounted upon a movable shaft 258 carried by the frame 220 and engageable in the guide track 223.

In the operation of the gap generating mechanism 210, the entrance pinch belts 211 and 231 are disposed adjacent to each other in a conveying section 215 that receives the shingled stream 160 from the infeed conveyor 200. The pinch belts 211 and 231 are operated at a first lower speed of for example 18 inches per second. The fast pinch belts 241 and 251 are operated at a higher speed, for example at a speed of 36 inches per second, as compared to the speed of the pinch belts 211 and 221. The idler rollers mounted on the frame 220 serve to separate the high speed pinch belts from the low speed pinch belts so that only one set of belts engage any portion of a shingled stream 160 at any point in time. More specifically, the idler rollers 217 and 219 for the upper slow pinch belt 211 and the idler rollers 237 and 239 for the slow lower pinch belt 231 disengage the slow pinch belts 211 and 231 from the shingled stream 160 prior to contact of the fast pinch belts 241 and 251 with the shingled stream 160. More specifically, the idler rollers 247 and 249 feed the upper fast pinch belt 241 into contact with the shingled stream 160 downstream with respect to the area of contact therewith by the slow pinch belt 211, and likewise the idler rollers 257 and 259 cause the lower fast pinch belt 251 to engage the shingled stream 160 downstream with respect to the point at which the slow pinch belt 231 engages the shingled stream 160. At the fast conveying section 245, the fast pinch belts 241 and 251 are engaging and driving the shingled stream 160 at a speed essentially twice that at which the shingled stream 160 was fed at the slow conveying section 215 by the pinch belts 211 and 231. By this arrangement, the portion of the shingled stream 160 ahead of the frame 220 and the idler rollers thereon is pinched between slower belts only, and the portion of the shingled stream 160 past the frame 220 is pinched between faster belts 241 and 251 only. As each leaflet in the shingled stream 160 passes the frame 220, its speed of propagation increases from slow to fast. The amount of overlap on consecutive leaflets in the shingled stream 160 is somewhat less in the fast region than in the slower region. The pitch, i,e., the distance between leading edges of consecutive leaflets, increases in proportion to the increase in speed.

As long as the frame 220 is held in a fixed position with respect to the machine frame 101, the shingled stream emerging from the fast pinch belts 241 and 251 remains continuous and uninterrupted. All of the leaflets in the shingled stream 160 that are upstream with respect to the frame 220 are moving slowly and all leaflets in the shingled stream 160 downstream with respect to the frame 220 are moving faster. To generate a gap in the shingled stream 160, the frame 220 is now moved forward or to the right at a speed in the range from about that of the slow pinch belts 211 and 231 to about that of the fast pinch belts 241 and 251, a preferred range of speed being one that is faster than that of the slow pinch belts 211 and 231 but slower than that of the faster pinch belts 241 and 251. All of the leaflets that are slow, i.e., upstream with respect to the frame 220 at the time it began moving will remain slow as long as the frame 220 is moving, because the point at which a leaflet could have changed its speed is moving ahead faster than the leaflet itself. The slow leaflets cannot catch up with the frame 220 at which they could have increased their speed. Conversely, those leaflets in the shingled stream 160 which are past the frame 220 and already moving faster will move away from the frame 220 faster than the speed at which the frame 220 is following. Thus the faster leaflets will maintain their higher speed. As long as the frame 220 is moving at a speed greater than that of the slower pinch belts 211 and 231 and slower than that of the fast pinch belts 241 and 251, the next leaflet which is slow will persist in its slow speed and the last leaflet in line ahead of the frame 220 will persist in its fast speed thus resulting in a relative displacement between the two leaflets. Once this displacement has exceeded the amount of the initial leaflet overlap, a gap in the shingled stream has been created. As soon as the gap has been created, the frame 220 can be stopped in its forward position. The gap will grow no longer since the leaflets behind the gap will pass the frame 220 and acquire the same speed as those downstream with respect to the frame 220. The result is that this constant gap will be maintained along the stream of leaflets.

In a given cross section through the shingled stream 160, the leaflets located at the bottom belong to the forward part of the stream, and the leaflets located on the top belong to the following part of the stream, this being a consequence of shingling. Because of this configuration of the leaflets in the shingled stream, the point of termination of the slow lower belt 231 must be upstream with respect to the point of termination of the slow upper pinch belt 211. Likewise, the point of initial contact of the lower fast pinch belt 251 must be upstream with respect to the point of initial contact of the fast upper pinch belt 241.

When the generation of the gap in the shingled stream 160 has been completed, the frame 220 carrying the movable idler rollers must essentially be returned to its rearward or left position to be ready to produce the next gap. While the frame 220 is being returned, the shingling density will be temporarily increased. For this reason, the frame 200 is returned slowly, so that the change in density is small, the extra leaflets found in the more dense portion of the stream making up for the missing leaflets in the area of the gap. When the gap has reached the delivery end 315 on the stacking conveyor 300, the shingled stream 160 can be more easily switched from the just filled container 170 to the next empty container 170, than the case wherein the shingled stream is continuous. More specifically, switching from one container to the next takes place during the gap in the shingled stream 160. A photocell 295 is provided, with a cooperating light source 296 at the conveying section 310 to sense a gap in the shingled stream 160, whereupon a control circuit (not shown) serves to actuate the pneumatic control system 360 to cause rapid shifting of the rollers 340 and 345 and the associated section of the pinch belt 301.

The power for driving the various conveyor systems described and forming a part of the machine 100 is derived from a conveyor drive motor 260 (see FIGS. 3A and 3B) provided with a transmission 261 driving an output sprocket 262. A main drive chain 263 engages the drive sprocket 262 and also engages driven sprockets 264 and 265 that respectively drive the drive rollers 287 and 322. Another drive chain 266 is driven by the sprocket 264 and in turn drives sprockets 267, 268 and 269, those sprockets in turn driving drive rollers 252, 242 and 282, respectively. Another drive chain 271 is driven from the sprocket 268 and in turn drives sprockets 272 and 273 that in turn drive the drive rollers 232 and 212, respectively. A further drive chain 275 is driven from the sprocket 265 and in turn drives the sprocket 276 which drives the drive roller 302.

Disposed between the outlet end of the gap generating mechanism 210 and the input end of the stacking conveyor 300 is a transfer conveyor 280 best illustrated in FIGS. 3A and 3B of the drawings. The transfer conveyor 280 includes an upper pinch belt 281 and a lower pinch belt 286 that cooperate to provide adjacent reaches forming a conveying section 285. The upper pinch belt 281 is driven by the drive roller 282 and is further supported by several support rollers 283. The lower pinch belt 286 is driven by a drive roller 287 and is further supported by a plurality of support rollers 288.

It often is desirable during the operation of the machine 100 to divert a portion of the shingled stream of leaflets to obtain a sample for inspection purposes, or to divert the entire stream if found defective. The shingled stream 160 can be diverted to the side on which the leading edges of the leaflets are located, i.e., the trailing or top side 165 as illustrated herein, by deforming the shingled stream 160 so that the leading edge of one leaflet fans out upward and thus separates from the stream. The leaflet which has fanned out of the shingled stream 160 can then be guided into an upward branching path. By virtue of the shingled configuration, all the leaflets which follow will then be guided by the preceding ones to follow the same path. A diverting station 400 has been provided in the gap in the upper pinch belt between the upper pinch belt 281 of the transfer conveyor 280 and the upper pinch belt 301 of the stacking conveyor 300. Disposed at the diverting station 400 is a finger 405 mounted on a shaft 406 so that it can be pivoted between the dashed line position disposed below the adjacent reach of the pinch belt 286 at the diverting station 400 and the upper solid line position wherein it serves to deflect the shingled stream 160 out of its normal path and away from the lower pinch belt 286.

The shingled stream 160 of leaflets from the diverting station 400 is fed to a diverting conveyor 410 including an upper pinch belt 411 and a lower pinch belt 421. The upper pinch belt 411 is supported and driven by a drive roller 412 and is further supported by a plurality of support rollers 413. The lower pinch belt 421 is supported and driven by a drive roller 422 and is further supported by a plurality of support rollers 423. The drive rollers 412 and 422 are driven by mechanism (not shown) so as to operate at a speed essentially equal to that of the transfer conveyor 280. The shingled stream 160 is clamped between the pinch belts 411 and 421 along a conveyor section 415 that leads from the diverting station 400 into a storage bin 425, and particularly into the entrance chute 426 therefor. The operator may retrieve one or more samples from the bin 425 for inspection purposes, and alternatively, the entire stream can be diverted into the bin 425 if it is defective in any regard.

Once the shingled stream 160 has been diverted into the diverting conveyor 410, it cannot be returned to its original path leading to the stacking conveyor 300 unless a gap is produced in the shingled stream 160 either at or upstream with respect to the diverting station 400. Accordingly, if the diverting station 400 is used to withdraw a small sample of leaflets from the shingled stream 160, then the gap generation mechanism 210 must be actuated first by the operator when he desires a sample. A photocell 290 and an associated light source 291 located some distance upstream of the diverting station 400 detects the arrival of the gap and through control mechanism (not shown) rotates the finger 405 from the dashed line position thereof to the solid line position thereof to initiate diversion. As soon as the gap in the shingled stream 160 reaches the diverting station 400, the finger 405 is returned to its original dashed line position and the direction of the shingled stream returns to its normal path, i.e., it is again directed to the stacking conveyor 300. The result of this operation is that only a limited number of leaflets is diverted for sampling.

In order to ascertain the number of leaflets withdrawn from the shingled stream 160, a first counting switch 430 is provided at the infeed conveyor 200, and a second counting switch 431 is provided at the inlet end of the stacking conveyor 300, the difference in the count of the counting switches 430 and 431 being the number of leaflets withdrawn.

Figure 9:
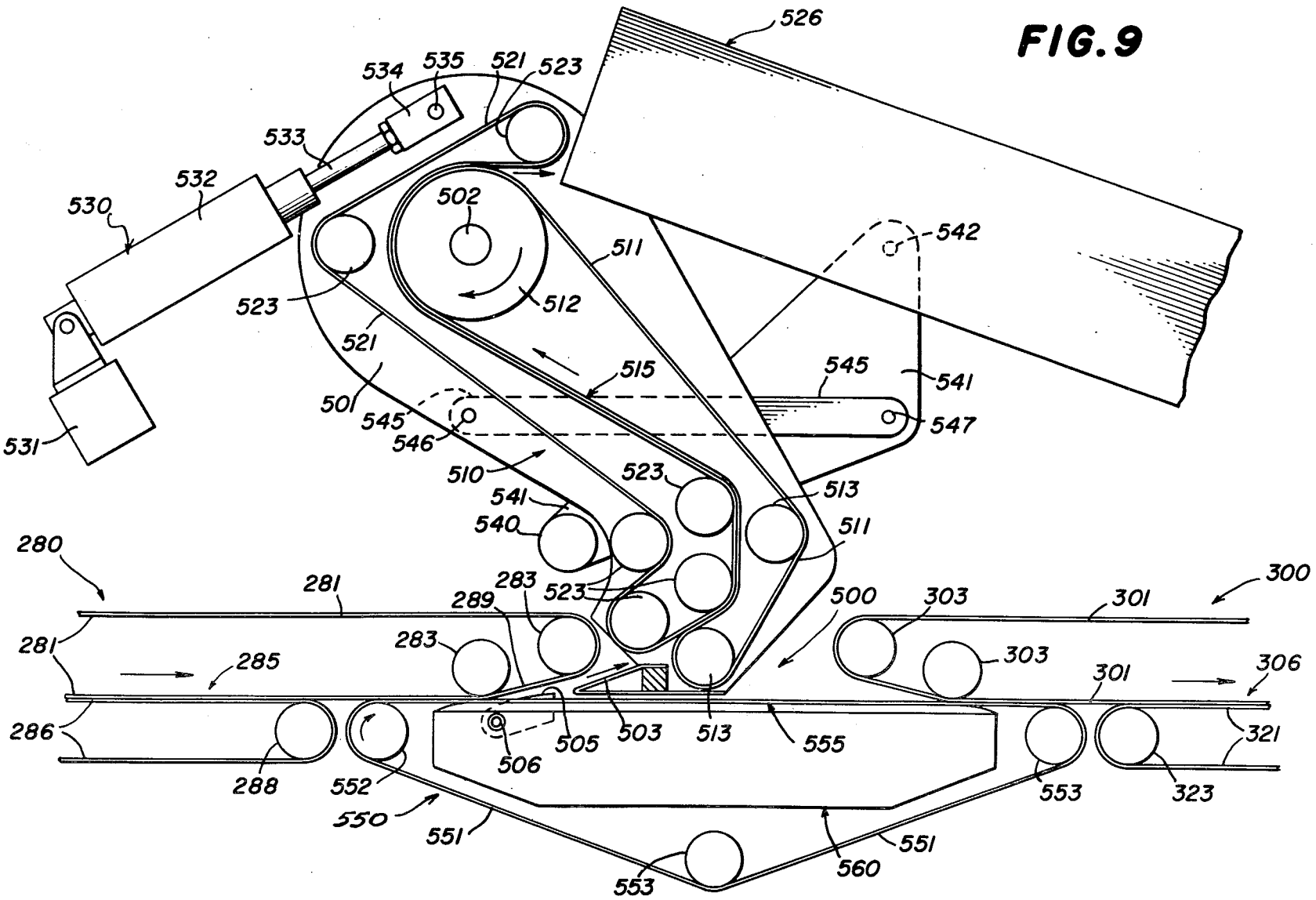
FIG. 9 is a partial diagrammatic view showing a second embodiment of a shingled stream diverting mechanism made in accordance with and embodying the principles of the present invention, the parts being shown in the diverting position thereof.
Figure 10:
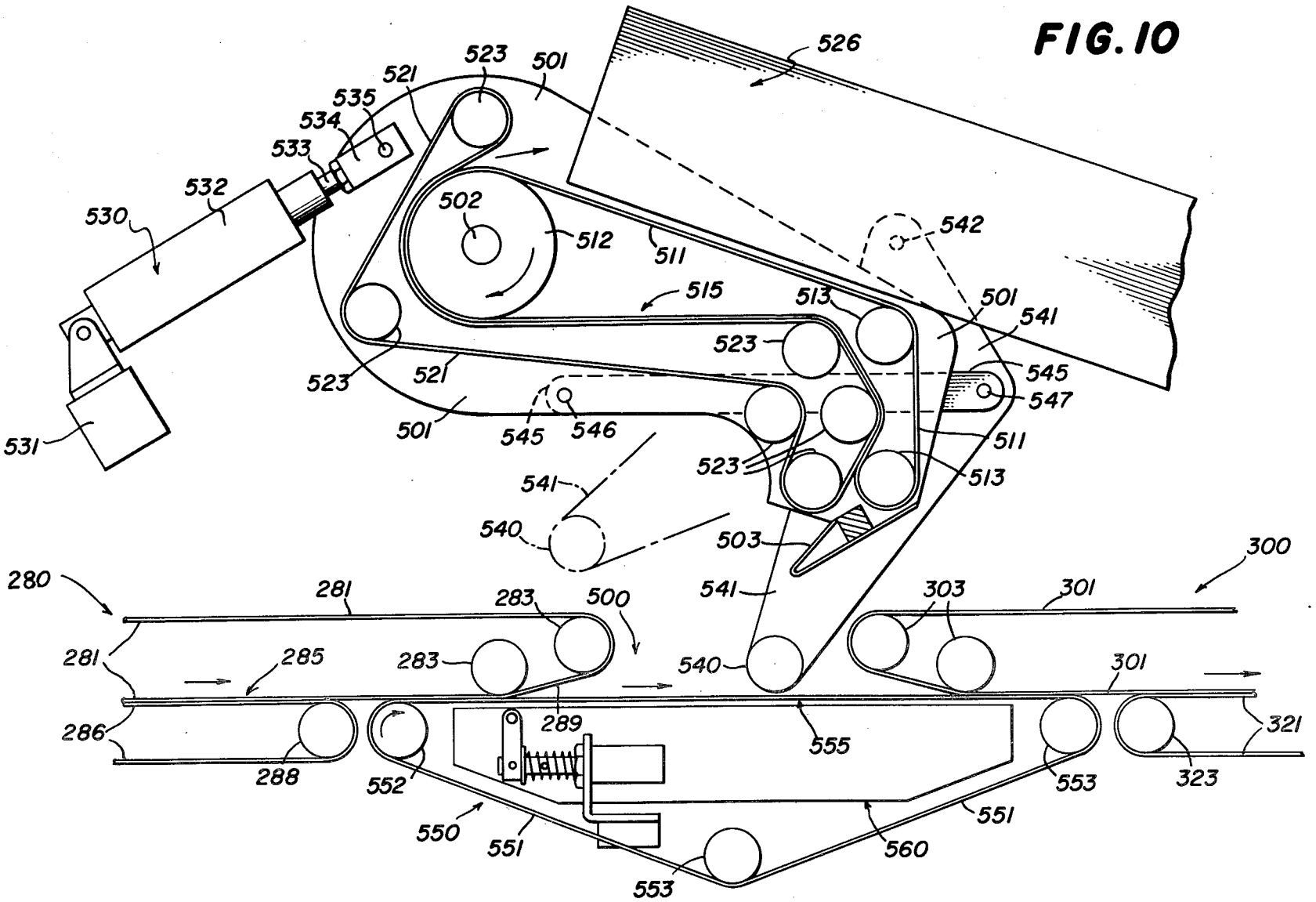
FIG. 10 is a view similar to FIG. 9 and illustrating the parts in the non-diverting positions thereof.

There is illustrated in FIGS. 9 and 10 of the drawings a mechanism which combines both the stream diverting function and the gap generating function, i.e., the mechanism serves to divert the shingled stream to the reject path, and thereafter generates a gap in the shingled stream which is necessary in order to return the shingled stream to its normal path. There is provided a space between the upper pinch belt 281 of the transfer conveyor 280 and the upper pinch belt 301 of the stacking conveyor 300 to accommodate a diverting station 500. Mounted adjacent to the diverting station 500 is a pick-up arm 501 that is mounted on a pivot-drive shaft 502. The arm 501 is essentially L-shaped and the shorter leg of the L carries an outwardly extending guide blade 503 which in the position illustrated in FIG. 9 can be used to direct a diverted stream away from the stacking conveyor 300. There is also provided at the diverting station 500 a finger 505 mounted on a pivot shaft 506 which when in the position illustrated in FIG. 9 deflects the shingled stream out of its path and onto the guide blade 503.

The stream diverted by the finger 505 and the guide blade 503 is directed to a diverting conveyor 510 including an upper pinch belt 511 and a lower pinch belt 521. The upper pinch belt 511 is mounted and driven by a drive roller 512 on the shaft 502 and is also provided with a plurality of support rollers 513. The lower pinch belt 521 also is driven by the drive roller 512 via the upper pinch belt 511 and is further supported by a plurality of support rollers 523. The upper pinch belt 511 and the lower pinch belt 521 cooperate to provide a conveyor section 515 that takes the shingled stream 160 of leaflets from the guide blade 503 upwardly to the entrance chute 526 for a storage bin.

If it is not desired to extract pamphlets from the stream flowing from the transfer conveyor 280 to the stacking conveyor 300, then the pick-up arm 501 and the parts mounted thereon are pivoted from the position illustrated in FIG. 9 to that illustrated in FIG. 10, wherein the guide blade 503 is spaced a substantial distance from the stream of leaflets. The described pivoting of the arm 501 is controlled by an air motor 530 having one end secured to the machine frame in a pivotal manner by means of a bracket 531. The motor 530 includes a cylinder 532 having a piston (not shown) therein connected to a piston rod 533 that is pivotally connected by a link 534 to a pivot 535 on the arm 501. By extending the air motor to the position illustrated in FIG. 9, the arm 501 and the parts thereon can be pivoted to the pick-up or diverting position, or alternatively, the air motor 530 can be operated to the position illustrated in FIG. 10, wherein the pick-up arm 501 and the parts thereon are in a non-diverting position.

In order to convey the shingled stream 160 of leaflets from the exit end of the transfer conveyor 280 to the entrance end of the stacking conveyor 300, a second transfer conveyor 550 is provided including a perforated belt 551 supported and driven by a drive roller 552 and further supported by support rollers 553. The upper reach 555 of the belt 551 bridges the space between the conveyors 280 and 300 to guide the shingled stream therebetween. There further is provided a pinch roller 540 intermediate the length of the upper reach 555 contacting the upper surface of the shingled stream 160 when the parts are in the positions illustrated in FIG. 10. The pinch roller 540 is mounted upon a bracket 541 that is pivoted to the machine frame as at 542 and is connected to the pick-up arm 501 by a link 545, one end of the link 545 being connected by a pivot 546 to the arm 501 and the other end of the link 545 being connected by a pivot 547 to the bracket 541. By this construction, the pinch roller 540 is automatically moved into operative position as the pick-up arm 501 is pivoted to the position illustrated in FIG. 10, and likewise is automatically pivoted to a position away from the conveyor reach 555 when the pick-up arm 501 is pivoted to the deflecting and diverting positions illustrated in FIG. 9. In order further to aid in holding the shingled stream 160 along the upper belt reach 555, a vacuum box 560 is disposed therebelow and acts through the perforated belt 551.

To initiate diversion of the shingled stream 160 using the mechanism of FIGS. 9 and 10, the pick-up arm 501 is pivoted to the position illustrated in FIG. 9 and at the same time the pinch roller 540 is withdrawn and the finger 505 is pivoted to the diverting position illustrated in FIG. 9. This causes the shingled stream 160 to be deformed so that the leading edge of an incoming leaflet fans out upwards and is diverted by the blade 503 which guides the diverted leaflet and subsequent leaflets into the diverting conveyor 510. The diverting conveyor 510 serves to convey the diverted shingled stream to the entrance chute 526 for a storage bin.

When the parts are in the position illustrated in FIG. 9, the point at which the pinching action by the conveyor section 285 terminates and the pinching action by the pinch belts on the diverting conveyor 510 start, is at least equal to and preferably slightly greater than the length of a leaflet. Thus as soon as a leaflet is pinched by the diverting conveyor 510, it is no longer pinched by the incoming conveyor section 285. The next leaflet which follows is still pinched by the transfer conveying section 285. If at this instant, the pick-up arm 501 is rapidly swung out of the position of FIG. 9 and into the position of FIG. 10, it will carry with it the first leaflet mentioned, and all that precede it. The leaflet still pinched by the transfer conveying section 285 will stay behind. During the motion of the pick-up arm 501, some of the leaflets which stayed behind will exit from the pinch of the transfer conveying section 285. However, those leaflets which are not pulled by the pick-up arm 501 and the diverting conveyor 510 thereon will be held by the vacuum from the vacuum chamber 560. In fact, if one leaflet is rapidly pulled forward, it causes more area of the next leaflet to be exposed to the vacuum chamber 560 through the perforated belt 551.

Preferably the pinch belts 511 and 521 of the diverting conveyor 510 move at a faster speed than those of the conveyors 280, 300 and 550, and preferably twice the speed thereof, for example 36 inches per second when the conveyors 280, 300 and 550 are operating at 18 inches per second. The rapid swinging motion of the arm 501 assisted by the fact that the pinch belts 511 and 521 run faster than those of the other conveyors, will cause a gap to be formed between the last leaflet pulled and the next one in line. At the same time that the arm 501 is swinging from the position of FIG. 9 to that of FIG. 10, the pinch roller 540 is swinging into position as illustrated in FIG. 10, thereby to push the following stream flat against the vacuum belt 551. In this manner, the normal flow path of the shingled stream 160 is restored from the transfer conveyor 280 across the transfer conveyor 550 to the input end of the stacking conveyor 300.

The diverting and gap generating mechanism of FIGS. 9 and 10 when associated with a transfer conveyor and a stacking conveyor makes it possible to operate the resulting system in three different modes. If the physical properties of the leaflets are such that no gap in the stream is needed for switching the stream from the just filled container 170 to the next empty container 170, then the system can operate in a first mode wherein the switching from one container 170 to the next is accomplished by deforming the shingled stream 160 and fanning out a leaflet into the next empty container 170, whereby the system can operate without a gap generating mechanism such as that designated by the numeral 210 herein. On the other hand, if a gap in the shingled stream 160 is needed for switching, the mechanism of FIGS. 9 and 10 may be used instead of the gap generating mechanism 210, thereby to permit operation of this system in a second mode. To operate in this second mode, a small sample of the leaflets must be taken out every time before changing the shingled stream 160 from the just filled container 170 to the next empty container 170. This reject and diverting mechanism is simpler than the gap generating mechanism 210, the only disadvantage of the second mode of operation being that a few leaflets are lost during the shift from one container to the next. Finally, if the consistency of the leaflets is such that the shingled stream 160 can not be deformed or fanned at the containers nor at the diverting station 500, then both the gap generator 210 of FIGS. 3A and 4 and the diverting mechanism of FIGS. 9 and 10 may be used in series, thus providing a third mode of operation. The gap which is generated by the mechanism 210 helps to start the diversion action at the diverting station 500, and the mechanism at the diverting station 500 creates the gap necessary for return to the normal path of the shingled stream.

There has been illustrated in FIGS. 1, 3A and 3B of the drawings a container transport system wherein the empty containers are fed countercurrent to the incoming shingled stream of leaflets and the direction of the filled containers 170 is reversed so that they are fed from the machine 100 in the same direction as the entry of the shingled stream 160 of leaflets. It will be appreciated that in place of the pivoting conveyor 145 illustrated, filled containers can also be conveyed away by conveyor systems that turn the path of travel through 90° or 180° from the incoming direction of the empty containers 170.

Figure 16:
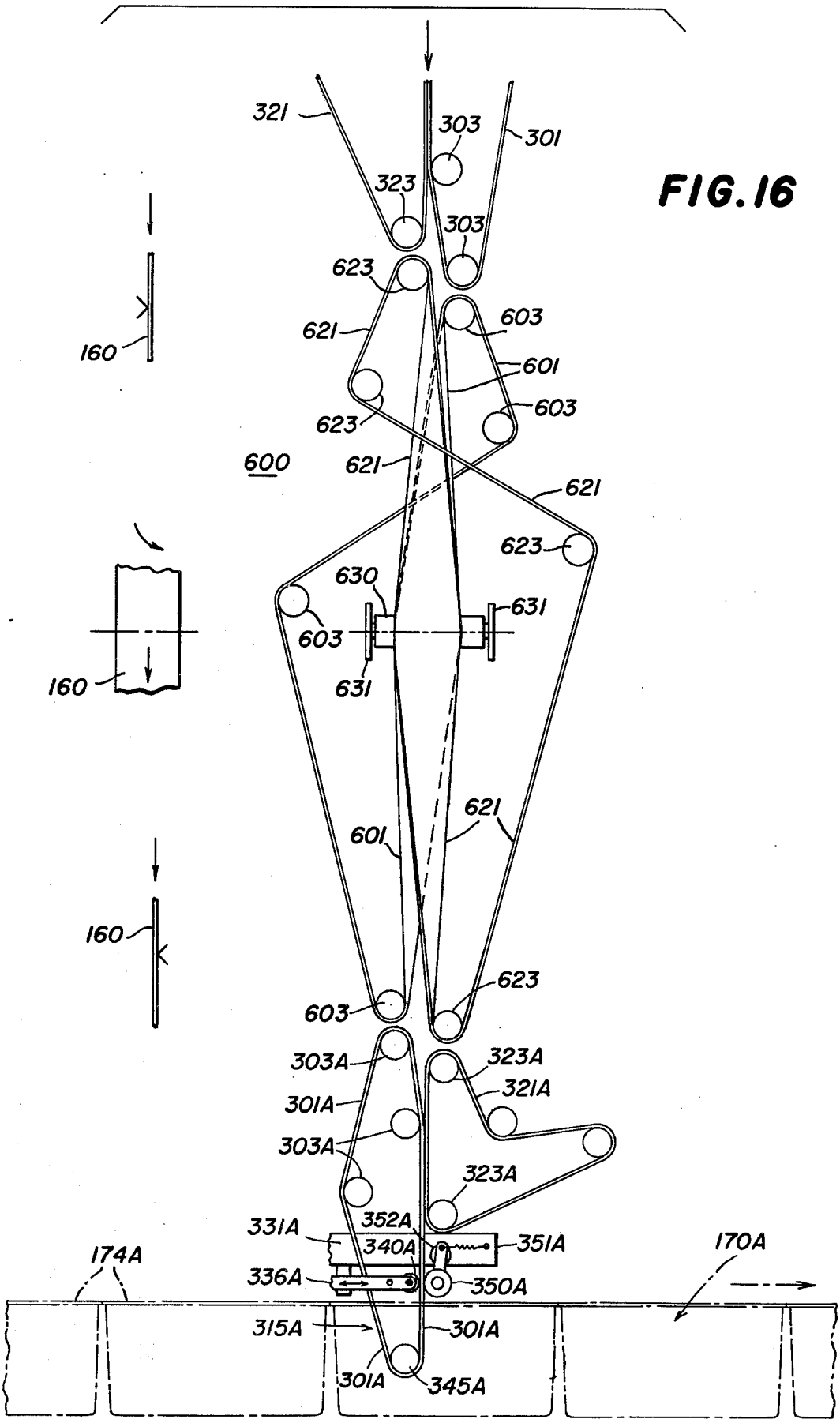
FIG. 16 is an enlarged view of a modified form of the delivery end of the stacking conveyor.

In yet another form of machine, the flow of incoming leaflets, empty containers and filled containers can all be in the same direction. To accomplish this, a 180° twist is formed in the conveying section 600 (see FIG. 16) so as to rotate the shingled stream 160 through 180° about its longitudinal axis. The twisted section 600 consists of two twisted pinch belts 601 and 621 on guide rollers 603, 623 and 630 (on supports 631) which contain the shingled stream. The result is that the trailing side 165 of the stream which was originally on top is moved to the bottom and vice versa by the twisting section. The twisted stream is then fed into the containers 170 with the trailing side 165 disposed to the left in FIG. 16 (instead of to the right as before), and accordingly the direction of stack formation is opposite from what it was as illustrated in FIG. 3B. Accordingly, the direction of movement of the containers 170 being filled may now be from left to right, rather than from right to left as originally. As a result, all of the streams involved move in the same direction, i.e., from left to right, including the shingled stream of leaflets 160, the line of empty conveyors 170 and the line of filled conveyors 170.

While there have been described what are at present considered to be certain preferred embodiments of the invention, it will be understood that various modifications may be made therein, and it is intended to cover in the appended claims all such modifications as fall within the true spirit and scope of the invention.

What is claimed is:

1. A system for stacking flat articles into containers with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof and a delivery end for feeding the shingled stream of flat articles from said stacking conveyor, means for moving a continuous line of containers and the delivery end of said stacking conveyor with respect to each other in a continuous manner, said delivery end being oriented essentially normal to the bottom of a container on said container conveyor, mechanism for shifting said delivery end and the containers with respect to each other following the filling of a container to place said delivery end at the front of the next empty container, stack support structure associated with said delivery end including one of said pinch belts extending into the associated container and terminating a short distance from the bottom thereof to support the forming stack of flat articles therein, and a following roller engaging the side of the shingled stream disposed away from said one pinch belt and resiliently urging the shingled stream against said one pinch belt during the relative shifting of the delivery end and the container, whereby said delivery end serves to feed the shingled stream of flat articles into successive containers to stack the flat articles therein without interruption.

2. The system set forth in claim 1, wherein said means for moving is a container conveyor operated at a speed equal to the speed that a stack is formed in a container thereon.

3. The system set forth in claim 1, wherein said following roller is disposed above the bottom of the container a distance at least equal to the length of a flat article.

4. The system set forth in claim 1, wherein said shifting mechanism rapidly shifts said delivery end from the rear of the just filled container to the front of the next empty container and thereafter slowly returns said delivery end to the original position thereof.

5. A system for stacking flat articles into containers having aligned slots in the ends thereof with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof and a delivery end for feeding the shingled stream of flat articles from said stacking conveyor, a container conveyor disposed adjacent to said stacking conveyor for conveying containers in a continuous manner past the delivery end of said stacking conveyor, said delivery end being oriented essentially normal to the bottom of a container of said container conveyor and including one of said pinch belts extending into the associated container and terminating a short distance from the bottom thereof, mechanism for shifting said delivery end rapidly from the rear of the just filled container to the front of the next empty container and through the aligned slots in the containers and thereafter slowly returning said delivery end to the original position thereof, and a following roller engaging the side of the shingled stream disposed away from said one pinch belt and resiliently urging the shingled stream against said one pinch belt during the shifting of the delivery end between containers, whereby said delivery end serves to feed the shingled stream of flat articles into successive containers to stack the flat articles therein without interruption.

6. A system for stacking flat articles into containers with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof and a delivery end for feeding the shingled stream of flat articles from said stacking conveyor, a container conveyor disposed adjacent to said stacking conveyor for conveying containers in a continuous manner past the delivery end of said stacking conveyor, said delivery end being oriented essentially normal to the bottom of a container on said container conveyor, mechanism for shifting said delivery end and the containers with respect to each other following the filling of a container to place the delivery end at the front of the next empty container, stack support structure associated with said delivery end and including one of said pinch belts extending into the associated container and terminating a short distance from the bottom thereof to support the forming stack of flat articles therein, a following roller engaging the side of the shingled stream disposed away from said one pinch belt and resiliently urging the shingled stream against said one pinch belt during the relative shifting of the delivery end and the containers, and sensing mechanism disposed adjacent to said container conveyor for sensing a movement corresponding to the completion of the stacking of flat articles in one container to actuate said shifting mechanism, whereby said delivery end serves to feed the shingled stream of flat articles into successive containers to stack the flat articles therein without interruption.

7. The system set forth in claim 6, wherein said sensing mechanism includes a microswitch engaging a container on said container conveyor upstream with respect to the container into which the flat articles are being stacked.

8. The system set forth in claim 6, wherein said shifting mechanism rapidly shifts said delivery end from the rear of the just filled container to the front of the next empty container and thereafter slowly returns said delivery end to the original position thereof.

9. A system for stacking flat articles into containers having aligned slots in the ends thereof with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof and a delivery end for feeding the shingled stream of flat articles from said stacking conveyor, a container conveyor disposed adjacent to said stacking conveyor for conveying containers in a continuous manner past the delivery end of said stacking conveyor, said delivery end being oriented essentially normal to the bottom of a container on said container conveyor and including one of said pinch belts extending into the associated container and terminating a short distance from the bottom thereof, mechanism for shifting said delivery end rapidly from the rear of the just filled container of the front of the next empty container and through the aligned slots in the containers and thereafter slowly returning said delivery end to the original position thereof, a following roller engaging the side of the shingled stream disposed away from said one pinch belt and resiliently urging the shingled stream against said one pinch belt during the shifting of the delivery end between containers, and sensing mechanism disposed adjacent to said container conveyor for sensing movement corresponding to the completion of the stacking of flat articles in one conveyor to actuate said shifting mechanism, whereby said delivery end serves to feed the shingled stream of flat articles into successive containers to stack the flat articles therein without interruption.

10. A system for stacking flat articles into containers with the flat articles disposed essentially normal to the bottoms of the containers, said system comprising a first cooperating set of pinch belts for conveying flat articles in a continuous shingled stream and along a predetermined path at a first predetermined speed, a second cooperating set of pinch belts for conveying flat articles in a continuous shingled stream along said predetermined path downstream with respect to said first set of pinch belts and at a second and greater predetermined speed, a gap generating member having a first set of rollers mounted thereon and engaging said first set of pinch belts for diverting them away from said predetermined path and having a second set of rollers mounted thereon ad engaging said second set of pinch belts for diverting them into said predetermined path at a point spaced along said predetermined path from said first set of rollers a distance at least equal to the length of a leaflet, mechanism for shifting said gap generating member along said predetermined path at a third speed in the range from about said first speed to about said second speed to generate a gap in the shingled stream of flat articles, a stacking conveyor including a third cooperating set of pinch belts for conveying the flat articles in a shingled stream and including an input end for receiving flat articles from said second set of pinch belts and a delivery end, a container conveyor disposed adjacent to said stacking conveyor for conveying containers in a continuous manner past the delivery end of said stacking conveyor, said delivery end being oriented essentially normal to the bottom of a container on said container conveyor, and a control mechanism for said shifting mechanism to cause said gap generating member to create a gap in the continuous shingled stream that will arrive at said delivery end upon the filling of the container, whereby said delivery end serves to feed the shingled stream of flat articles into the successive containers to stack the flat articles therein without interruption.

11. The system set forth in claim 10, wherein said second predetermined speed is approximately twice said first predetermined speed.

12. The system set forth in claim 10, wherein said shifting mechanism operates to return said gap generating member to its original position slowly after the generation of a gap in the shingled stream.

13. A system for stacking flat articles into containers having aligned slots in the ends thereof with the flat articles disposed essentially normal to the bottoms of the containers, said system comprising a first cooperating set of pinch belts for conveying flat articles in a continuous shingled stream and along a predetermined path at a first predetermined speed, a second cooperating set of pinch belts for conveying flat articles in a continuous shingled stream along said predetermined path downstream with respect to said first set of pinch belts and at a second and greater predetermined speed, a gap generating member having a first set of rollers mounted thereon and engaging said first set of pinch belts for diverting them away from said predetermined path and having a second set of rollers mounted thereon and engaging said second set of pinch belts for diverting them into said predetermined path at a point spaced along said predetermined path from said first set of rollers a distance at least equal to the length of a flat article, first mechanism for shifting said gap generating member along said predetermined path at a third speed in the range from about said first speed to about said second speed to generate a gap in the shingled stream, a stacking conveyor including a third cooperating set of pinch belts for conveying the flat articles in a shingled stream and including an input end for receiving flat articles from said gap generating member and a delivery end, a container conveyor disposed adjacent to said stacking conveyor for conveying containers in a continuous manner past the delivery end of said stacking conveyor, said delivery end being oriented essentially normal to the bottom of a container on said container conveyor and extending downwardly into the associated container and terminating a short distance from the bottom thereof, second mechanism for shifting said delivery end rapidly from the rear of the just filled container to the front of the next empty container and through the aligned slots in the containers, and a control mechanism for said first and second shifting mechanisms to cause said gap generating member to create a gap in the continuous shingled stream that will arrive at said delivery end when said delivery end shifting mechanism is operated, whereby said delivery end serves to feed the shingled stream of flat articles into the successive containers to stack the flat articles therein without interruption.

14. A system for stacking flat articles into containers with the flat articles disposed essentially normal to the bottoms of the containers, said system comprising a first cooperating set of pinch belts for conveying flat articles in a continuous shingled stream and along a predetermined path at a first predetermined speed, a second cooperating set of pinch belts for conveying flat articles in a continuous shingled stream along said predetermined path downstream with respect to said first set of pinch belts and at a second and greater predetermined speed, a gap generating member having a first set of rollers mounted thereon and engaging said first set of pinch belts for diverting them away from said predetermined path and having a second set of rollers mounted thereon and engaging said second set of pinch belts for diverting them into said predetermining path at a point spaced along said predetermined path from said first set of rollers a distance at least equal to the length of a flat article, mechanism for shifting said gap generating member along said predetermined path at a third speed in the range from about said first speed to about said second speed to generate a gap in the shingled stream of flat articles, a stacking conveyor including a third cooperating set of pinch belts for conveying the flat articles in a shingled stream and including an input end for receiving flat articles from said second set of pinch belts and a delivery end, one of the pinch belts of said third set being in two sections with a space therebetween to provide a diverting station between said input end and said delivery end, a diverting conveyor having its input end adjacent to said diverting station and including a fourth cooperating set of pinch belts for conveying flat articles in a shingled stream, diverting mechanism mounted adjacent to said diverting station and operative in a first condition to feed the stream of flat articles to said delivery end and operative in a second condition to divert the stream of flat articles to said diverting conveyor and from said delivery end, a container container conveyor disposed adjacent to said stacking conveyor for conveying containers in a continuous manner past the delivery end of said stacking conveyor, said delivery end being oriented essentially normal to the bottom of a container on said container conveyor, and a control mechanism for said shifting mechanism to cause said gap generating member to create a gap in the continuous shingled stream that will arrive at said diverting station when it is desired to redivert the shingled stream from said diverting conveyor to said delivery end, whereby when said diverting mechanism is in its first condition the stream of flat articles is fed to said delivery end which serves to feed the stream of flat articles into the associated container to stack the flat articles therein and when said diverting mechanism is in its second condition the stream of flat articles is fed to said diverting conveyor.

15. The system set forth in claim 14, wherein said diverting station is disposed on the trailing side of the shingled stream.

16. The system set forth in claim 14, wherein said diverting mechanism is a finger for contracting the leading side of a shingled stream.

17. A system for stacking flat articles into containers with the flat articles disposed essentially normal to the bottoms of the containers, said system comprising a stacking conveyor including a first cooperating set of pinch belts for conveying the flat articles in a shingled stream, said stacking conveyor having an input end for receiving flat articles from a source thereof and a delivery end for feeding the shingled stream of flat articles from said stacking conveyor, one of the pinch belts of said first set being in two sections with a space therebetween to provide a diverting station between said input end and said delivery end, a diverting conveyor pivotally mounted adjacent to said diverting station and including a second cooperating set of pinch belts for conveying flat articles in a shingled stream, means for pivoting said diverting conveyor between a first position wherein its input end is spaced away from said diverting station and a second position wherein its input end is disposed at said diverting station, diverting mechanism mounted adjacent to said diverting station and operative in a first condition and when said diverting conveyor is pivoted to its first position to feed the stream of flat articles to said delivery end and operative in a second condition when said diverting conveyor is pivoted to its second position to divert the stream of flat articles to said diverting conveyor and from said delivery end, and a container conveyor disposed adjacent to such stacking conveyor for conveying containers in a continuous manner past said delivery end of said stacking conveyor, said delivery end being oriented essentially normal to the bottom of a container on said container conveyor, whereby when said diverting conveyor is pivoted to its first position and said diverting mechanism is in its first condition the stream of flat articles is fed to said delivery end which serves to feed the stream of flat articles into the associated container to stack the flat articles therein, and whereby when said diverting conveyor is pivoted to its second position and said diverting mechanism is in its second condition the stream of flat articles is fed to said diverting conveyor.

18. The system set forth in claim 17, wherein said diverting station is disposed on the trailing side of the shingled stream.

19. The system set forth in claim 17, wherein said diverting mechanism is a finger for contacting the leading side of the shingled stream to divert it to said diverting conveyor.

20. The system set forth in claim 17, wherein the pinch belt contacting the leading side of the shingled stream at said diverting station is perforated, and a vacuum box is provided in operative relationship with said perforated belt so as to hold the shingled stream against said perforated belt.

21. The system set forth in claim 17, wherein the exit ends of said first set of pinch belts at said diverting station terminate at a point spaced from the input ends of said second belts a distance equal at least to the length of a flat article in the shingled stream.

22. The system set forth in claim 17, and further comprising a pinch roller connected to said diverting mechanism and operative when said diverting conveyor is in the first position thereof to contact the trailing side of the shingled stream and being shifted away from the shingled stream when said diverting conveyor is in the second position thereof.

23. A system for stacking into containers having aligned slots in the ends thereof flat articles with the flat articles disposed essentially normal to the bottoms of the containers, said system comprising a first cooperating set of pinch belts for conveying flat articles in a continuous shingled stream and along a predetermining path at a first predetermined speed, a second cooperating set of pinch belts for conveying flat articles in a continuous shingled stream along said predetermined path downstream with respect to said first set of pinch belts and at a second and greater predetermined speed, a gap generating member having a first set of rollers mounted thereon and engaging said first set of pinch belts for diverting them away from said predetermined path and having a second set of rollers mounted thereon and engaging said second set of pinch belts for diverting them into said predetermined path at a point spaced along said predetermined path from said first set of rollers a distance at least equal to the length of a leaflet, first mechanism for shifting said gap generating member along said predetermined path at a third speed in the range from about said first speed to about said second speed to generate a gap in the shingled stream, a stacking conveyor including a third cooperating set of pinch belts for conveying the flat articles in a shingled stream including a shingled stream with the gap therein provided by said gap generating member, said stacking conveyor having an input end for receiving flat articles from said second set of pinch belts and a delivery end for feeding the shingled stream of flat articles from said stacking conveyor, one of the pinch belts of said third set being in two sections with a space therebetween to provide a diverting station along said stacking conveyor between said input end and said delivery end, a diverting conveyor having its input end adjacent to said diverting station and including a fourth cooperating set of pinch belts for conveying flat articles in a shingled stream, diverting mechanism adjacent to said diverting station and operative in a first condition to feed the stream of flat articles to said delivery end and operative in a second condition to divert the stream of flat articles to said diverting conveyor and from said delivery end, a container conveyor disposed adjacent to said stacking container for conveying containers in a continuous manner past the delivery end of said stacking conveyor, said delivery end being oriented essentially normal to the bottom of a container on said container conveyor and extending downwardly into the associated container and terminating a short distance from the bottom thereof, second mechanism for shifting said delivery end and the containers with respect to each other following the filling of a container and through the aligned slots in the containers to place said delivery end at the front of the next empty container, and a control mechanism for said first and second shifting mechanisms and for said diverting mechanism to cause said gap generating member to create a gap in the continuous shingled stream that will arrive at said diverting station as said diverting mechanism is shifted from the second condition thereof to the first condition thereof and to cause said gap generating member to create a gap in the continuous shingled stream that will arrive at said delivery end when said second shifting mechanism is operated, whereby said diverting conveyor may be utilized selectively to divert a portion of the continuous shingled stream and subsequently have the shingled stream returned to feed said delivery end, and whereby said gap generating member at the appropriate time creates a gap in the continuous shingled stream that will arrive at said delivery end when said second shifting mechanism is operated thereby to feed the shingled stream of flat articles into the successive containers to stack the flat articles therein without interruption.

24. The system set forth in claim 23, wherein said first mechanism operates to return said gap generating member to its original position slowly after the generation of a gap in the shingled stream.

25. The system set forth in claim 23, wherein the pinch belt of said first set of pinch belts contacting the leading side of the shingled stream terminates first, and the pinch belt of said second set of pinch belts contacting the leading side of the shingled stream engages the shingled stream first.

26. The system set forth in claim 23, wherein said diverting station is disposed on the trailing side of the shingled stream.

27. The system set forth in claim 23, wherein said diverting mechanism is a finger for contacting the leading side of the shingled stream.

28. A system for stacking flat articles into containers having aligned slots in the ends thereof with the flat articles disposed essentially normal to the bottoms of the containers, said system comprising a first cooperating set of pinch belts for conveying flat articles in a continuous shingled stream and along a predetermined path at a first predetermined speed, a second cooperating set of pinch belts for conveying flat articles in a continuous shingled stream along said predetermined path downstream with respect to said first set of pinch belts and at a second and greater predetermined speed, a gap generating member having a first set of rollers mounted thereon and engaging said first set of pinch belts for diverting them away from said predetermined path and having a second set of rollers mounted thereon and engaging said second set of pinch belts for diverting them into said predetermined path at a point spaced along said predetermined path from said first set of rollers a distance at least equal to the length of a flat article, first mechanism for shifting said gap generating member along said predetermined path at a third speed in the range from about said first speed to about said second speed to generate a gap in the shingled stream, a stacking conveyor including a third cooperating set of pinch belts for conveying the leaflets in a shingled stream including a shingled stream with the gap therein provided by said gap generating member, said stacking conveyor having an input end for receiving flat articles from said second set of pinch belts and a delivery end for feeding the shingled stream of flat articles from said stacking conveyor, one of the pinch belts of said third set being in two sections with a space therebetween to provide a diverting station along said stacking conveyor between said input end and said delivery end, a diverting conveyor pivotally mounted adjacent to said diverting station and including a fourth cooperating set of pinch belts for conveying flat articles in a shingled stream, means for pivoting said diverting conveyor between a first position wherein its input end is spaced away from said diverting station and a second position wherein its input end is disposed at said diverting station, diverting mechanism mounted adjacent to said diverting station and operative in a first condition and when said diverting conveyor is pivoted to its first position to feed the stream of flat articles to said delivery end and operative in a second condition when said diverting conveyor is pivoted to its second position to divert the stream of flat articles to said diverting conveyor and from said delivery end, a container conveyor disposed adjacent to said stacking container for conveying containers in a continuous manner past the delivery end of said stacking conveyor, said delivery end being oriented essentially normal to the bottom of a container on said container conveyor and extending downwardly into the associated container and terminating a short distance from the bottom thereof, a second mechanism for shifting said delivery end rapidly from the rear of the just filled container to the front of the next empty container and through the aligned slots in the containers, and a control mechanism for said first and second shifting mechanisms and for said pivoting means and for said diverting mechanism to cause said gap generating member to create a gap in the continuous shingled stream that will arrive at said diverting station as said diverting mechanism is shifted from the second condition thereof to the first condition thereof and to cause said gap generating member to create a gap in the continuous shingled stream that will arrive at said delivery end when said second shifting mechanism is operative, whereby said diverting conveyor may be utilized selectively to divert a portion of the continuous shingled stream and subsequently have the shingled stream returned to feed said delivery end, and whereby said gap generating member at the appropriate time creates a gap in the continuous shingled stream that will arrive at said delivery end when said second shifting mechanism is operated thereby to feed the shingled stream of flat articles into the successive containers to stack the flat articles without interruption.

29. The system set forth in claim 28, wherein said first mechanism operates to return said gap generating member to its original position slowly after the generation of a gap in the shingled stream.

30. The system set forth in claim 28, wherein the pinch belt of said first set of pinch belts contacting the leading side of the shingled stream terminates first, and the pinch belt of said second set of pinch belts contacting the leading side of the shingled stream engages the shingled stream first.

31. The system set forth in claim 28, wherein said diverting station is disposed on the trailing side of the shingled stream.

32. The system set forth in claim 28, wherein said diverting mechanism is a finger for contacting the leading side of the shingled stream to divert it to said diverting conveyor.

33. The system set forth in claim 28, wherein the pinch belt contacting the leading side of the shingled stream at said diverting station is perforated, and a vacuum box is provided in operative relationship with said perforated belt so as to hold the shingled stream against said perforated belt.

34. The system set forth in claim 28, wherein the exit ends of said first set of pinch belts at said diverting station terminate a distance spaced from the input ends of said second belt a distance equal at least to the length of a flat article in the shingled stream.

35. The system set forth in claim 28, and further comprising a pinch roller connected to said diverting mechanism and operative when said diverting conveyor is in the first position thereof to contact the trailing side of the shingled stream and being shifted away from the shingled stream when said diverting conveyor is in the second position thereof.

36. A mechanism for generating a gap in a continuous shingled stream of flat articles, said gap generating mechanism comprising a first cooperating set of pinch belts for conveying flat articles in a continuous shingled stream and along a predetermined path at a first predetermined speed, a second cooperating set of pinch belts for conveying flat articles in a continuous shingled stream along said predetermined path downstream with respect to said first set of pinch belts and at a second and greater predetermined speed, a gap generating member having a first set of rollers mounted thereon and engaging said first set of pinch belts for diverting them away from said predetermined path and having a second set of rollers mounted thereon and engaging said second set of pinch belts for diverting them into said predetermined path at a point spaced along said predetermined path downstream from said first set of rollers, and drive mechanism for shifting said gap generating member along said predetermined path at a third speed in the range from about said first speed to about said second speed to generate a gap in the shingled stream of leaflets.

37. The gap generating mechanism set forth in claim 36, wherein said second predetermined speed is twice said first predetermined speed.

38. The gap generating mechanism set forth in claim 36, wherein said second set of pinch belts is diverted into the predetermined path downstream from said first set of rollers a distance equal to about the length of a flat article.

39. The gap generating mechanism set forth in claim 36, wherein said drive mechanism operates to return said gap generating member to its original position slowly after the generation of a gap in the shingled stream.

40. The gap generating mechanism set forth in claim 36, wherein the pinch belt of said first set of pinch belts contacting the leading side of the shingled stream terminates first, and the pinch belt of said second set of pinch belts contacting the leading side of the shingled stream engages the shingled stream first.

41. A mechanism for diverting a shingled stream of flat articles, said stream diverting mechanism comprising a main conveyor including a first cooperating set of pinch belts for conveying the flat articles in a shingled stream, one of the pinch belts of said first set being in two sections with a space therebetween to provide a diverting station between the ends of said main conveyor, a diverting conveyor pivotally mounted adjacent to said diverting station and including a second cooperating set of pinch belts for conveying flat articles in a shingled stream, means for pivoting said diverting conveyor between a first position wherein its input end is spaced away from said diverting station and a second position wherein its input end is disposed at said diverting station, and diverting mechanism mounted adjacent to said diverting station and operative in a first condition and when said diverting conveyor is pivoted to its first position to feed the stream of flat articles past said diverting station and to the outlet end of said main conveyor and operative in a second condition when said diverting conveyor is pivoted to its second position to divert the stream of flat articles to said diverting conveyor.

42. The stream diverting mechanism set forth in claim 41, wherein said diverting station is disposed on the trailing side of the shingled stream.

43. The stream diverting mechanism set forth in claim 41, wherein said diverting mechanism is a finger for contacting the leading side of the shingled stream to divert it to said diverting conveyor.

44. The stream diverting mechanism set forth in claim 41, wherein the pinch belt contacting the leading side of the shingled stream at said diverting station is perforated, and a vacuum box is provided in operative relationship with said perforated belt so as to hold the shingled stream against said perforated belt.

45. The stream diverting mechanism set forth in claim 41, wherein the exit ends of said first set of pinch belts at said diverting station terminate at a point spaced from the input ends of said second belt a distance equal at least to the length of a flat article in the shingled stream.

46. The stream diverting mechanism set forth in claim 41, and further comprising a pinch roller connected to said diverting mechanism and operative when said diverting conveyor is in the first position thereof to contact the trailing side of the shingled stream and being shifted away from the shingled stream when said diverting conveyor is in the second position thereof.

47. A system for stacking flat articles into containers with the flat articles disposed essentially normal to the bottoms of the containers, said system comprising a first cooperating set of pinch belts for conveying flat articles in a continuous shingled stream and along a predetermined path at a first predetermined speed, a second cooperating set of pinch belts for conveying flat articles in a continuous shingled stream along said predetermined path downstream with respect to said first set of pinch belts and at a second and greater predetermined speed, a gap generating member having a first set of rollers mounted thereon and engaging said first set of pinch belts for diverting them away from said predetermined path and having a second set of rollers mounted thereon and engaging said second set of pinch belts for diverting them into said predetermined path at a point spaced along said predetermined path from said first set of rollers a distance at least equal to the length of a leaflet, mechanism for shifting said gap generating member along said predetermined path at a third speed in the range from about said first speed to about said second speed to generate a gap in the shingled stream of flat articles, a stacking conveyor including a third cooperating set of pinch belts for conveying the flat articles in a shingled stream and including an input end for receiving flat articles from said second set of pinch belts and a delivery end, said input end feeding the shingled stream along a predetermined path and said delivery end changing the predetermined path and twisting the shingled stream 180° about the axis of the path of travel thereof, a container conveyor disposed adjacent to said stacking conveyor for conveying containers in a continuous manner past the delivery end of said stacking conveyor in the same general direction as said input end feeds the shingled stream of flat articles, said delivery end being oriented essentially normal to the bottom of a container on said container conveyor, and a control mechanism for said shifting mechanism to cause said gap generating member to create a gap in the continuous shingled stream that will arrive at said delivery end upon the filling of the container, whereby said delivery end serves to feed the shingled stream of flat articles into the successive containers to stack the flat articles therein without interruption with said stacking conveyor feeding the shingled stream in the same general direction that said container conveyor feeds the containers to said delivery end.

* * * * *

UNITED STATES PATENT AND TRADEMARK OFFICE

CERTIFICATE OF CORRECTION

PATENT NO. : 4,161,092

DATED : July 17, 1979

INVENTOR(S) : John M. Buday et al.

It is certified that error appears in the above-identified patent and that said Letters Patent are hereby corrected as shown below:

Column 1, line 49, "3,862,329" should be --3,682,329--.
Column 7, line 35, "for" should be --four--.
Column 8, line 3, "60" should be --50--.
Column 14, line 26, "200" should be --220--.
Column 21, line 41, "ad" should be --and--.
Column 23, line 20, delete "container" first occurrence;
line 42, "contracting" should be --contacting--.

Signed and Sealed this

*First* Day of *January 1980*

[SEAL]

*Attest:*

SIDNEY A. DIAMOND

*Attesting Officer*

*Commissioner of Patents and Trademarks*